US010081980B2

(12) United States Patent
Birkert et al.

(10) Patent No.: US 10,081,980 B2
(45) Date of Patent: Sep. 25, 2018

(54) MESH BARRIER ASSEMBLY

(71) Applicant: MUNCHKIN, INC., Van Nuys, CA (US)

(72) Inventors: Thomas E. Birkert, West Hills, CA (US); Sung Yun Chan, Pasadena, CA (US); Ruth Hsin-Ju Fang, Monterey Park, CA (US); Nicholas Trumbo, La Canada, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/818,017

(22) Filed: Aug. 4, 2015

(65) Prior Publication Data

US 2016/0069113 A1 Mar. 10, 2016

Related U.S. Application Data

(60) Provisional application No. 62/046,851, filed on Sep. 5, 2014.

(51) Int. Cl.

| | |
|---|---|
| ***E06B 11/02*** | (2006.01) |
| ***E06B 11/04*** | (2006.01) |
| ***E06B 9/04*** | (2006.01) |
| *E06B 9/00* | (2006.01) |

(52) U.S. Cl.

CPC ..... *E06B 11/04* (2013.01); *E06B 9/04* (2013.01); *E06B 2009/002* (2013.01)

(58) Field of Classification Search

CPC ..... E06B 3/92; E06B 2009/002; E06B 11/02; E06B 11/04

USPC ..... 49/50, 55, 56, 57, 380, 464, 463; 160/371, 381, 372

See application file for complete search history.

(56) References Cited

U.S. PATENT DOCUMENTS 354,824 A * 12/1886 Apoll ..... F16B 5/02 160/381

894,289 A * 7/1908 Schumacher ..... E06B 9/52 160/228

(Continued)

OTHER PUBLICATIONS

Munchkin, Munchkin Wood and Steel Designer Gate, Amazon.com, Apr. 2014,Search Date Oct. 25, 2015 from the Internet at <http://www.amazon.com/gp/product/B004CL9YHS?keywords=munchkin%20wood%20and%20steel%20designer%20gate&qid=1445876210&ref_=sr_1_2&sr=8-2>, pp. 1-8.

(Continued)

*Primary Examiner* — Katherine W Mitchell
*Assistant Examiner* — Johnnie A. Shablack
(74) *Attorney, Agent, or Firm* — Robert Z. Evora, Esq.; Christian Lek

(57) ABSTRACT

A pressure fit mesh gate having an outer casing and a mesh barrier door. The outer casing has a pair of upright frame elements connected to a lower cross element. The mesh barrier door is positioned within the outer casing. The mesh barrier door is hingedly connected to one of the upright frame elements. The barrier door has a frame including a first side member and a second side member friction fit connected at their ends by corner joints to an upper member and a lower member. At least one of the corner joints is a two-part corner joint. The two-part corner joint has a first extension that is friction fit into a first end of one of the members, and a second extension friction fit into an adjacent end of another one of the members.

16 Claims, 24 Drawing Sheets

(56) References Cited

U.S. PATENT DOCUMENTS 2,207,381 A * 7/1940 Lang ..... E06B 9/52 160/381
2,310,539 A * 2/1943 Nelson ..... E06B 9/01 160/159
2,350,235 A * 5/1944 Johnson ..... E06B 9/42 160/387
2,975,536 A * 3/1961 Schindler ..... E06B 11/02 256/24
3,037,593 A * 6/1962 Webster ..... E04B 2/7425 160/135
3,269,455 A * 8/1966 Gillotti ..... B60J 1/2011 160/369
3,537,201 A * 11/1970 Friedrichsen ..... G09F 17/00 40/604
3,648,981 A * 3/1972 Allen ..... E06B 11/02 256/24
3,875,623 A * 4/1975 Johnston ..... A41F 1/00 160/392
3,997,144 A * 12/1976 Parisien ..... E06B 11/02 160/371
4,132,390 A * 1/1979 Pfarr, Jr. ..... E04H 17/066 160/392
4,150,510 A * 4/1979 Harrison ..... E06B 11/00 49/388
4,337,815 A * 7/1982 Lindstrom ..... F16B 2/16 160/327
4,375,134 A * 3/1983 Sheetz ..... G09F 7/00 116/173
4,380,327 A * 4/1983 Fish ..... E04H 4/06 256/24
4,570,406 A 2/1986 Difazio
5,200,240 A * 4/1993 Baker ..... E04F 11/18 256/59
5,328,156 A * 7/1994 Hoke ..... E04H 17/02 256/1
5,402,988 A * 4/1995 Eisele ..... E01F 13/022 160/351
5,531,258 A 7/1996 Poulson et al.
5,657,809 A * 8/1997 Longoria ..... E06B 9/04 160/160
5,702,090 A * 12/1997 Edgman ..... E04H 17/1421 256/19
5,758,868 A * 6/1998 Shea ..... E01F 7/02 256/12.5
5,787,955 A * 8/1998 Dargie ..... E02D 29/12 160/368.1
5,797,218 A * 8/1998 Holland ..... E06B 9/04 49/55
5,868,382 A * 2/1999 Groves ..... E06B 11/02 256/24
5,878,802 A * 3/1999 Richter ..... A47G 5/00 160/135
6,176,042 B1 * 1/2001 Rossman ..... A01K 1/0017 160/210
6,296,041 B1 * 10/2001 Cicero ..... E06B 9/02 160/327
6,446,395 B2 * 9/2002 Rogers ..... E06B 9/04 160/215
6,474,021 B2 * 11/2002 Homeyer ..... A47D 9/005 160/372
6,499,254 B2 * 12/2002 Rossman ..... A01K 1/0017 160/210
6,530,165 B2 * 3/2003 Griesemer ..... G09F 15/0025 160/378
6,655,087 B2 * 12/2003 Andersen ..... E06B 9/04 49/55
6,881,005 B2 * 4/2005 Sosa ..... E06B 3/964 256/65.05
7,090,201 B2 * 8/2006 Brucker ..... E04H 17/166 256/19
7,118,096 B2 * 10/2006 Petrozziello ..... E04H 17/066 256/1
7,152,372 B2 * 12/2006 Cheng ..... E05C 1/06 49/465
7,178,792 B2 * 2/2007 Monahan ..... E06B 9/08 160/10
7,334,624 B2 * 2/2008 Waldman ..... E05B 17/2053 160/144
7,373,755 B2 * 5/2008 Jefferys ..... E05F 1/066 49/394
7,437,843 B2 * 10/2008 Lefebvre ..... G09F 7/00 242/395
7,540,046 B1 * 6/2009 Lai ..... A47D 13/065 256/26
7,735,541 B2 * 6/2010 Ocampo ..... B44D 3/185 101/127.1
7,775,256 B2 * 8/2010 Kim ..... E06B 3/9641 160/100
7,883,288 B2 * 2/2011 Jorna ..... F16B 7/0453 403/171
7,975,431 B2 * 7/2011 Flannery ..... E06B 7/32 49/463
8,261,736 B1 * 9/2012 Olivarri ..... F24B 1/192 126/545
8,327,565 B2 * 12/2012 Boltz ..... G09F 15/0025 256/24
8,341,886 B2 * 1/2013 Yates ..... E05B 65/0007 204/468
8,448,381 B2 * 5/2013 Flannery ..... E06B 9/04 49/169
8,468,743 B2 * 6/2013 Ting ..... E05B 47/026 160/180
8,528,257 B2 * 9/2013 Kobayashi ..... A01K 1/034 49/463
8,578,656 B2 * 11/2013 Yates ..... E06B 9/0653 49/464
8,596,619 B2 * 12/2013 Volin ..... E04H 17/163 256/73
8,607,502 B2 * 12/2013 Flannery ..... E06B 9/04 292/170
8,615,928 B2 * 12/2013 Wang ..... E04H 17/00 49/226
8,615,931 B2 * 12/2013 Dunn ..... E06B 9/04 160/215
8,627,602 B2 * 1/2014 Yates ..... E06B 9/04 49/55
8,646,756 B2 * 2/2014 Mann ..... E06B 3/76 256/73
8,650,741 B1 * 2/2014 Piper ..... E06B 11/02 256/59
8,875,444 B2 * 11/2014 Dunn ..... E06B 9/04 160/215
8,893,417 B2 * 11/2014 Miller ..... G09F 15/00 116/28 R
9,051,770 B2 * 6/2015 Yates ..... E06B 9/0653
9,097,050 B2 * 8/2015 Yates ..... E05B 65/0007
9,366,055 B1 * 6/2016 Wright ..... E04H 17/00
2005/0116213 A1 * 6/2005 Dahowski ..... E04H 17/161 256/24
2006/0081826 A1 * 4/2006 Cheng ..... E06B 9/04 256/22
2006/0192190 A1 * 8/2006 Brucker ..... E04H 17/16 256/24
2007/0056701 A1 * 3/2007 Brooker ..... E06B 9/52 160/381
2007/0294944 A1 * 12/2007 Pedersen ..... E06B 9/04 49/50
2009/0158665 A1 * 6/2009 Wu ..... E06B 9/02 49/55
2009/0226246 A1 * 9/2009 Piper ..... E06B 11/02 403/235
2010/0206497 A1 * 8/2010 Ocampo ..... B44D 3/185 160/374.1
2012/0174484 A1 * 7/2012 Toro ..... E06B 9/04 49/50
2012/0285099 A1 * 11/2012 Yates ..... E06B 9/0623 49/503

(56) References Cited

U.S. PATENT DOCUMENTS

| | | | | |
|---|---|---|---|---|
| 2012/0324792 | A1* | 12/2012 | Bertsch | E06B 9/04 49/37 |
| 2013/0212950 | A1* | 8/2013 | Bertsch | E06B 9/04 49/464 |
| 2015/0101250 | A1* | 4/2015 | Marsden | E06B 9/0623 49/55 |
| 2016/0245381 | A1* | 8/2016 | Birkert | F16H 25/20 |

OTHER PUBLICATIONS

International Search Report, dated Jan. 19, 2016, pp. 1-2.
Written Opinion of the International Searching Authority, dated Jan. 19, 2016, pp. 1-5.
Search History, Search Date Oct. 26, 2015, pp. 1-3.

* cited by examiner

MESH BARRIER ASSEMBLY

CROSS REFERENCE TO RELATED APPLICATION

This application incorporates and claims the benefit of the filing date of U.S. Provisional Patent Application Ser. No. 62/046,851, entitled "MESH BARRIER ASSEMBLY" filed Sep. 5, 2014, the entirety of which is incorporated herein by reference.

TECHNICAL FIELD

The subject disclosure relates to barrier devices. More particularly, the present disclosure relates to a mesh panel barrier.

BACKGROUND

Falls are a leading cause of injuries to children and toddlers in the home. Safety gates can be used around the home to prevent children from entry into a staircase region or keep the children in a safe area in the home where they can be watched by a caregiver. Additionally, safety gates can be used to prevent movement of small household pets into unwanted spaces or rooms. However, traditional safety gates, such as mesh barrier type gates are often times difficult to transport and assemble, making it unduly cumbersome to try to move the gate to another location. Previous attempts at solving these deficiencies often resulted in gates with decreased structural stability.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
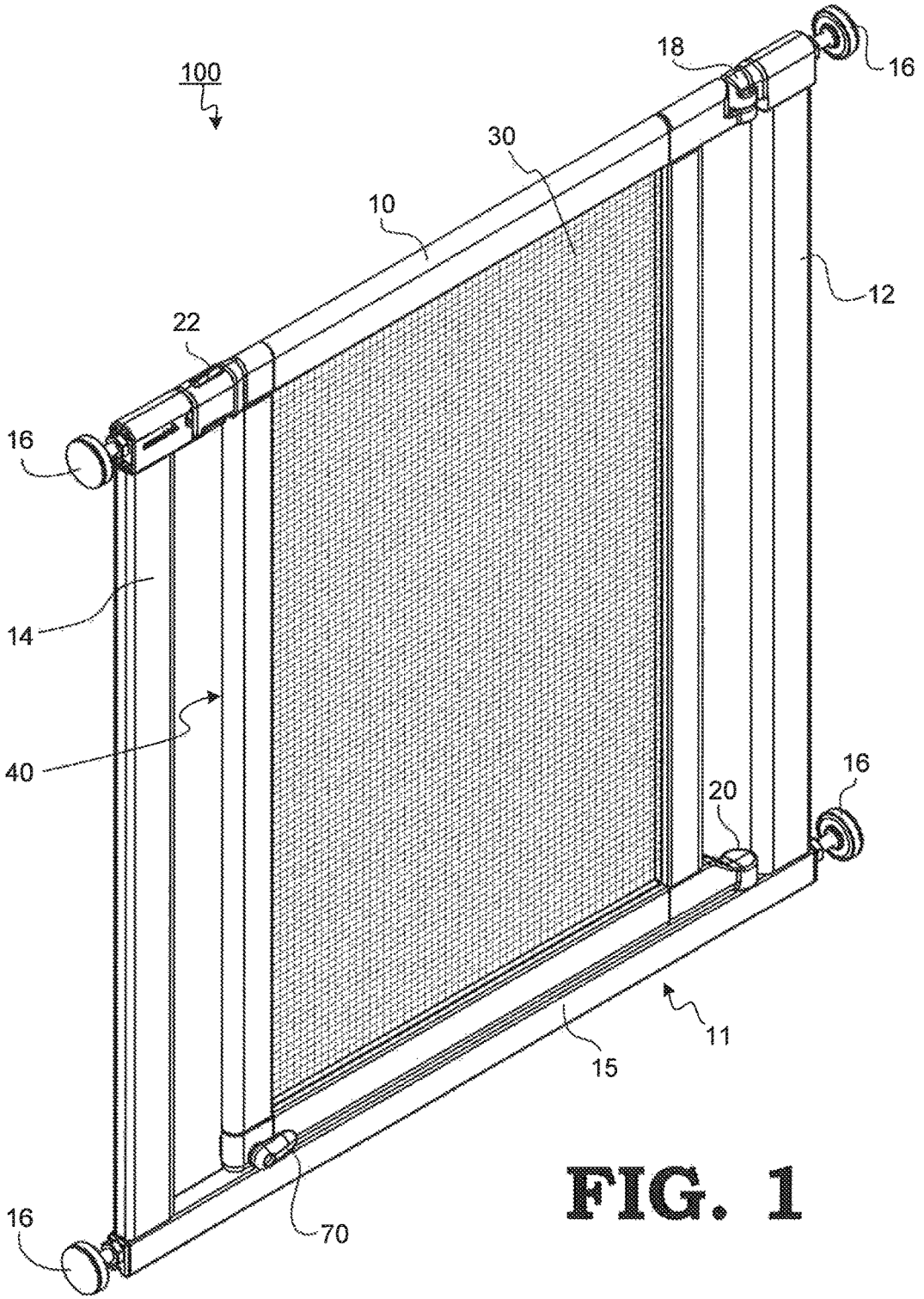
FIG. 1 illustrates an exemplary mesh barrier assembly in accordance with aspects described herein.

FIG. 1 illustrates an exemplary mesh barrier assembly 100 in accordance with aspects described herein. The mesh barrier assembly has a barrier or barrier door 10 hingedly attached to an outer casing or support structure 11 by an upper hinge 18 and a lower hinge 20. The barrier 10 includes a mesh panel 30 and a barrier door or mesh panel frame 40. The support structure 11 includes a first upright frame element or vertical support structure 12, a second upright frame element or vertical support structure 14, a lower cross element or horizontal support structure 15, a plurality of adjustable fasteners 16, a barrier latch 22 and a stopper 70.

The mesh barrier assembly 100 may be installed between two walls, a door frame, etc. by positioning the mesh barrier assembly 100 such that the plurality of adjustable fasteners 16 rest abuttingly against the walls or door frames. The plurality of adjustable fasteners 16 may then be tightened or loosened to create a friction fit such that the fasteners 16 do not move relative to the walls or door frame when the mesh barrier assembly 100 is in use.

Generally, the barrier 10 may be opened by releasing the barrier latch 22 and pivoting the barrier 10 about the upper and lower hinges 18, 20. The stopper 70 may prevent the barrier 10 from opening outwards, inwards, or both while in a locked position.

The mesh panel 30 may be constructed out of any flexible or rigid mesh materials, or may alternatively be made of a fabric or suitable material. The mesh panel 30 may have any suitable size, shape or configuration to provide a barrier preventing children, infants or animals from crossing though the barrier. The mesh panel 30 may be a single construction, or may alternatively have a first material extending from a center of the mesh panel 30 and a second material proximate to the edges of the mesh panel 30, or any combination of materials.

The mesh panel 30 may also include different designs on one or both faces. These designs may be formed by apertures in the mesh, different materials which compose the mesh panel 30, different mesh densities used throughout the mesh panel 30, and materials permanently or removably attached to the face of the mesh panel 30, or any other suitable method by which to add the design to the mesh panel 30.

Figure 2:
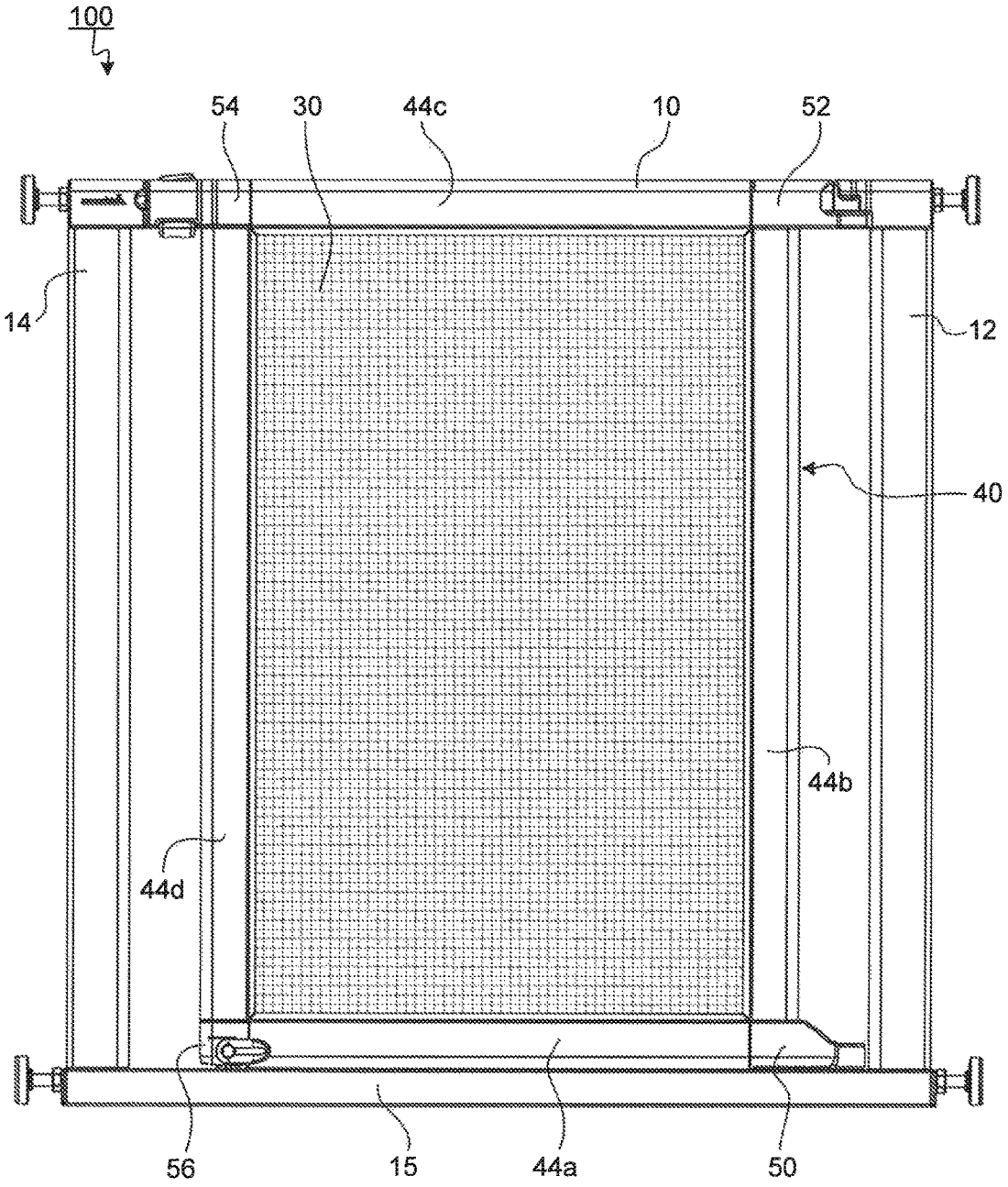
FIG. 2 depicts a front view of the mesh barrier assembly having a barrier with an integrated mesh panel.

FIG. 2 depicts a front view of the mesh barrier assembly 100 having the barrier 10 with the integrated mesh panel 30 and mesh panel frame 40 or barrier door frame. The mesh panel frame 40 includes a lower frame member 44*a*, a first side frame member 44*b*, an upper frame member 44*c*, a second side frame member 44*d*, a first corner joint or first corner member 50, a second corner member 52, a third corner member 54 and a fourth corner member 56 which receive and secure the mesh panel 30 into the barrier 10.

Figure 3:
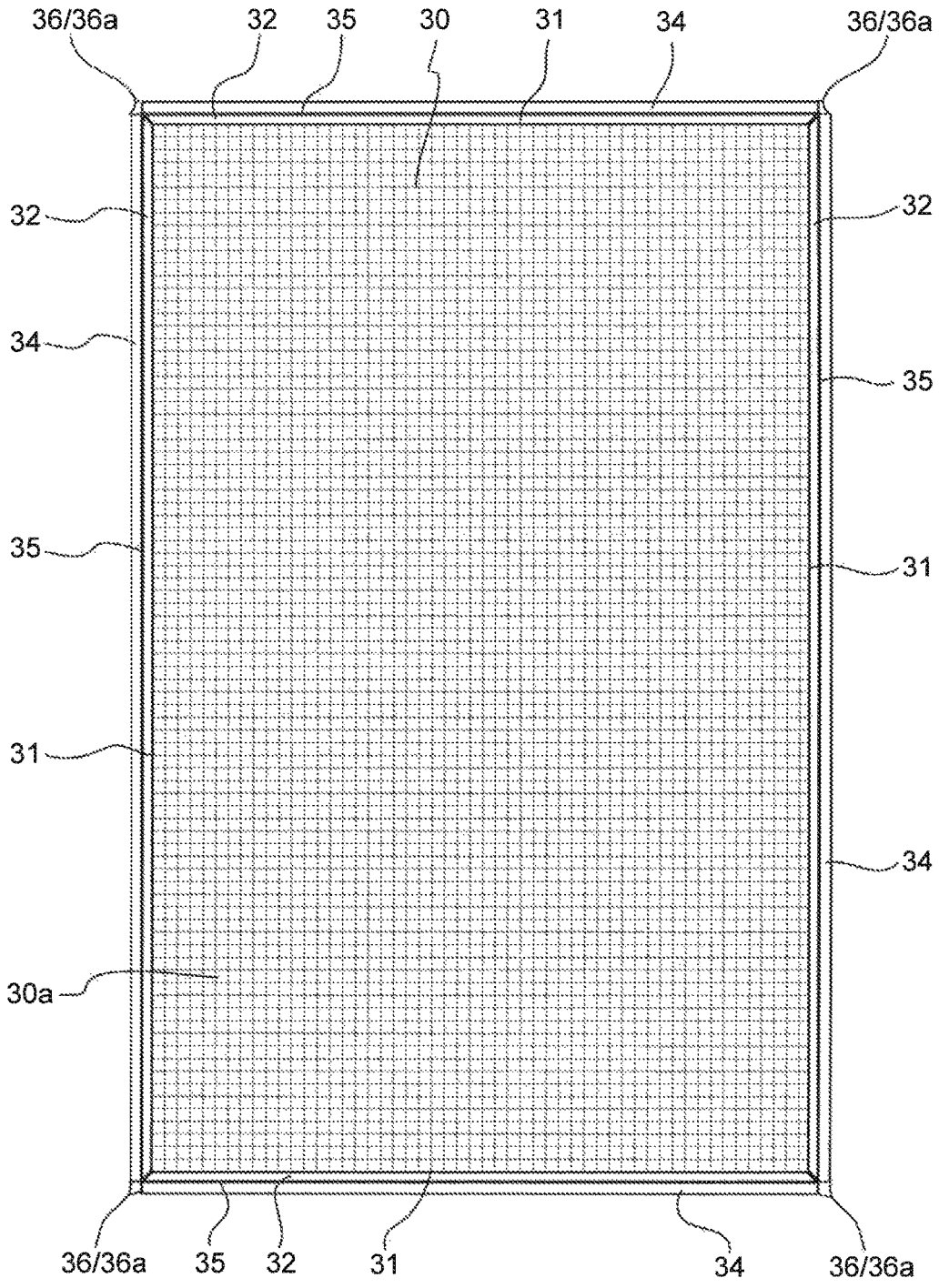
FIG. 3 shows a front view of the mesh panel.

FIG. 3 shows a front view of the mesh panel 30. The mesh panel 30 includes four edges 31 which may be folded towards a center of the mesh panel 30 to form folds 34. The edges 31 are then attached to an inner face 30*a* of the mesh panel 30 at a sealing location 32 by heat sealing, metal fixtures, sewing, knotting, or any other suitable method for attaching the edges 31 to the inner face 30*a*. Each fold 34 forms a substantially cylindrical pocket 36 having openings 36*a* on corners of the mesh panel 30 as shown. Each of the pockets 36 is sealed along its length at an inner location 35 where the mesh panel 30 is two layers thick and sealed by one of the previously mentioned methods.

Figure 4:
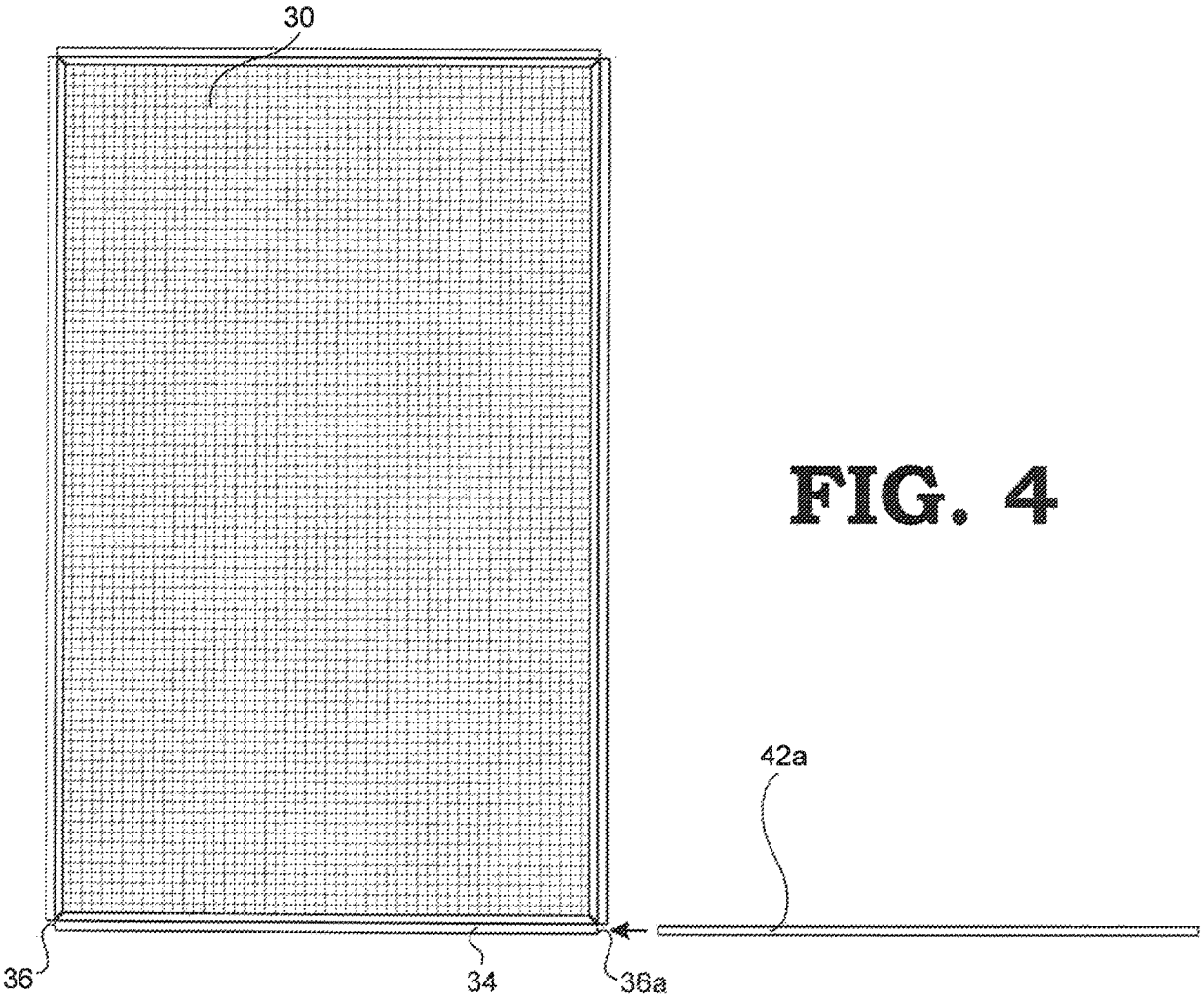
FIG. 4 illustrates a first step of assembling the barrier by inserting a first rod into a first fold of the mesh panel.
Figure 5:
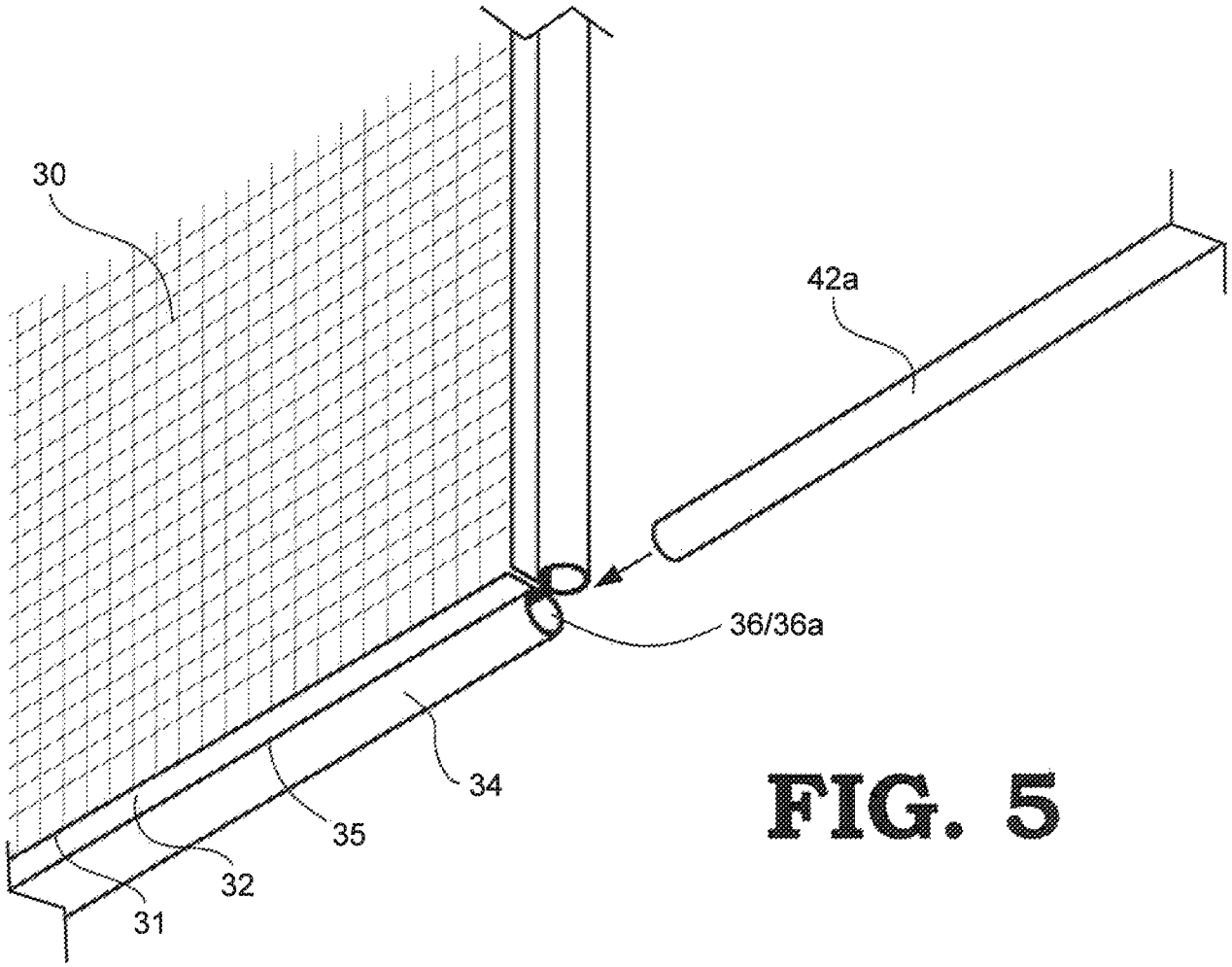
FIG. 5 depicts a detail view of the first step from FIG. 4.

FIGS. 4-5 illustrate a first step of assembling the barrier 10 by inserting a first rod 42*a* into a first fold 34 of the mesh panel 30. The first rod 42*a* has an outer diameter barely smaller than the inner diameter of the pocket 36 and opening 36*a*. As such, the opening 36*a* receives a first end the first rod 42*a*. As the first rod 42*a* is inserted into the pocket 36, the mesh panel 30 will remain two layers of mesh thick at the inner location 35. When the first rod 42*a* is completely inserted into the pocket 36, the length of pocket 36 and the length of the first rod 42*a* may be coincident to one another. Whereas before the first rod 42*a* is inserted into the pocket 36, the first fold 34 which forms the pocket 36 will be flexible; however, after the first rod 42*a* is inserted the first fold 34 will grip the first rod 42*a* and may be substantially cylindrical encompassing an outer surface of the first rod 42*a*.

Figure 6:
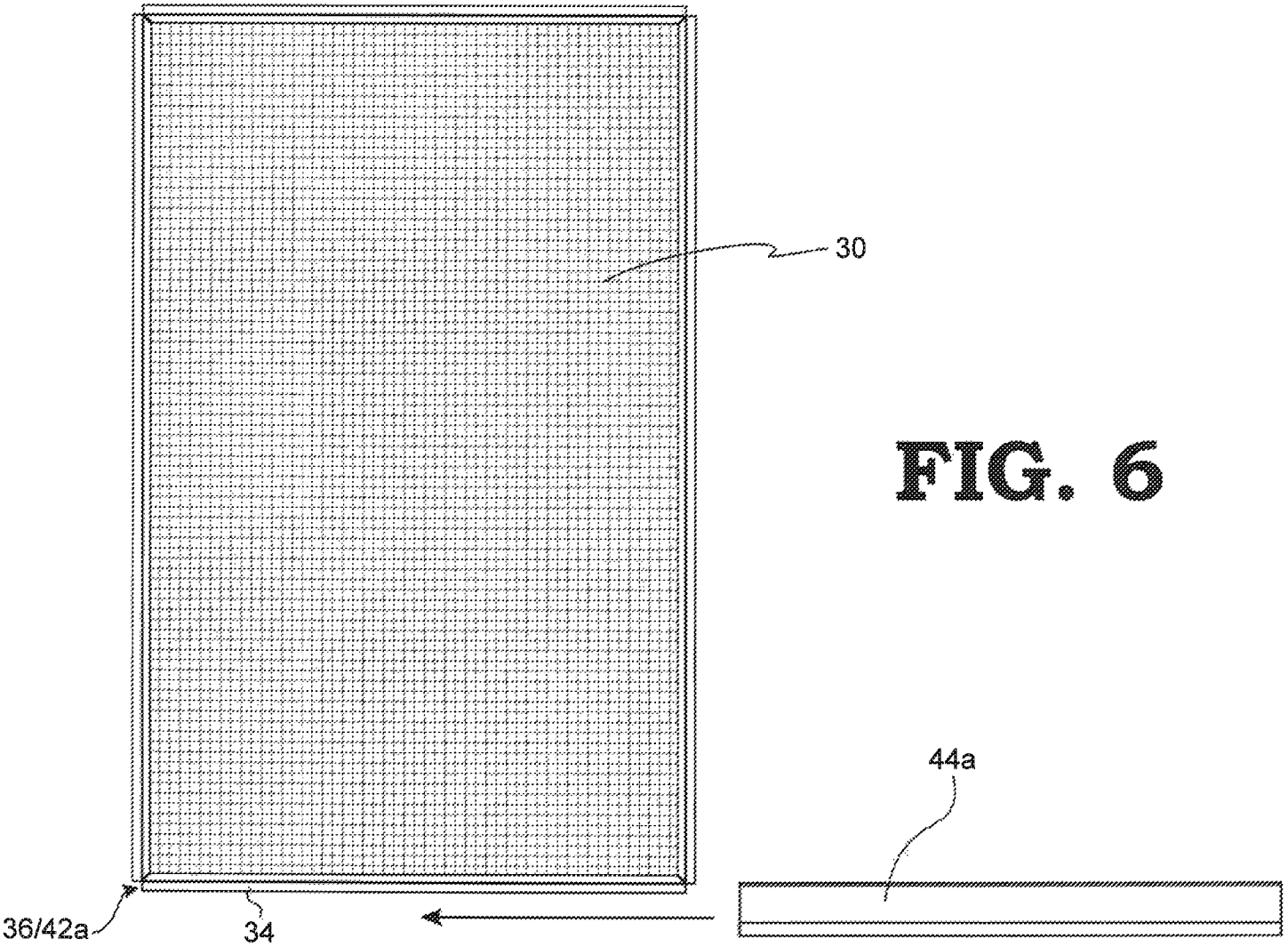
FIG. 6 shows a second step of assembling the barrier by attaching a lower frame member to the mesh panel and rod combination.
Figure 7:
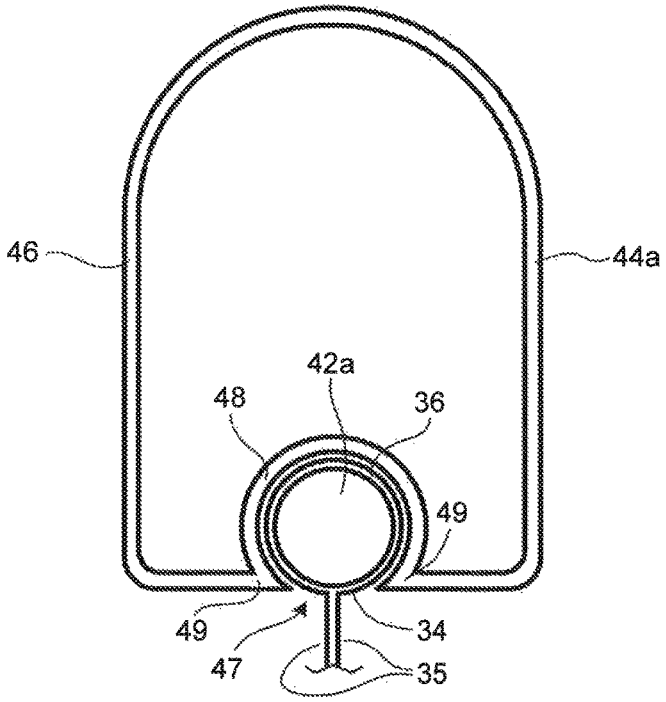
FIG. 7 illustrates a side view of the lower frame member when attached to the mesh panel and rod combination.
Figure 8:
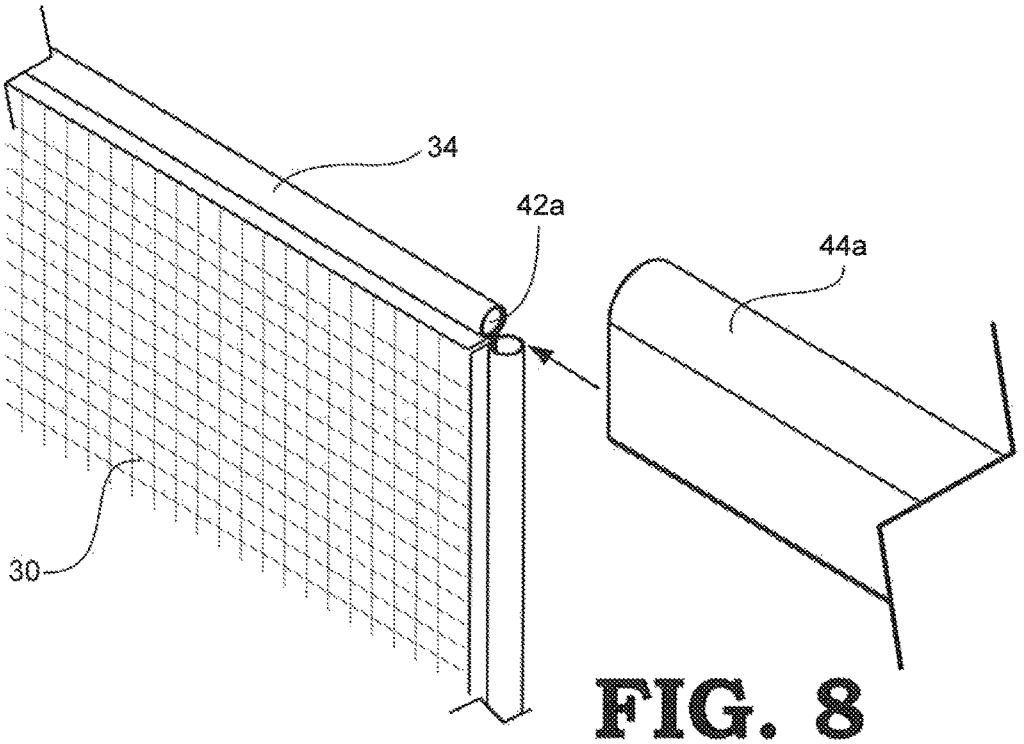
FIG. 8 depicts a detailed view of the second step from FIG. 6.

FIGS. 6-8 show a second step of assembling the barrier 10 by attaching a lower frame member 44*a* to the mesh panel 30 and rod 42*a* combination. As shown in FIG. 6, the lower frame member 44*a* secures and receives the first fold 34 which in stiffened by the first rod 42*a*. The lower frame member 44*a* slides over the combination of the fold 34 and first rod 42*a* until a length of the lower frame member 44*a* is substantially congruent to the length of the first rod 42*a*.

FIG. 7 depicts a detailed view of the lower frame member 44*a* after receiving the fold 34 and first rod 42*a* combination. As shown, the lower frame member 44*a* (as well as a first side frame member 44*b*, an upper frame member 44*c* and a second side frame member 44*d*) includes a frame member body 46 and a round track 48 with overhang portions 49. The round track 48 is substantially coincident to both the fold 34 and the first rod 42*a* when the barrier 10 is assembled. The overhang portions 49 prevent the first rod 42*a* from sliding out through an opening 47 of the round track 48. This configuration traps the mesh panel 30 between the first rod 42*a* and the lower frame member 44*a*. Such a configuration may be embodied as a tongue and groove mating system, a projection and channel mating system and/or any other suitable mating connection according to this subject disclosure. As shown in FIG. 8, when the lower frame member 44*a* is being installed, the sealed portion 35 of the mesh panel 30 slides within the opening 47.

Figure 9:
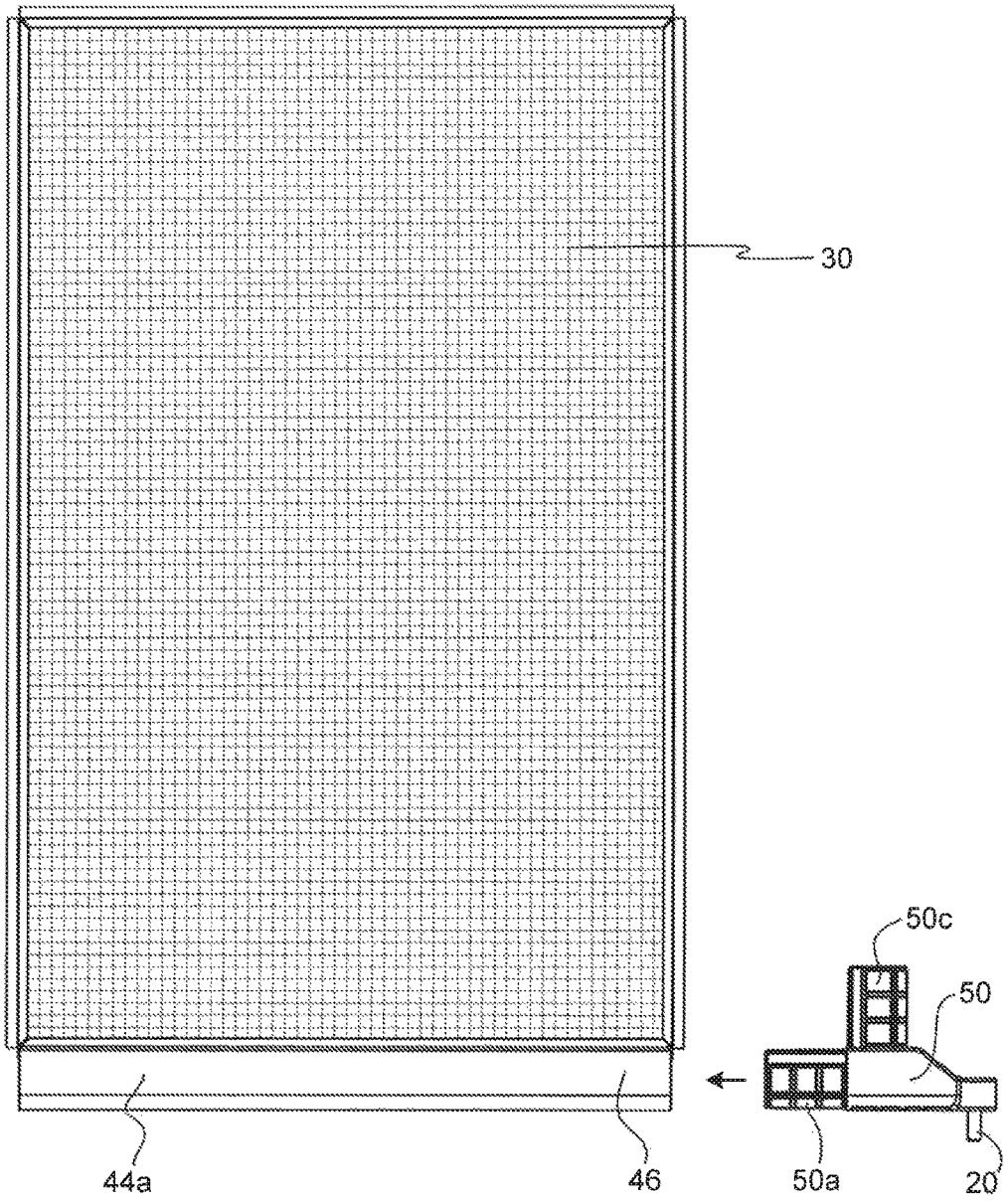
FIG. 9 shows a third step of assembling the barrier by inserting a first corner member into the lower frame member.
Figure 10:
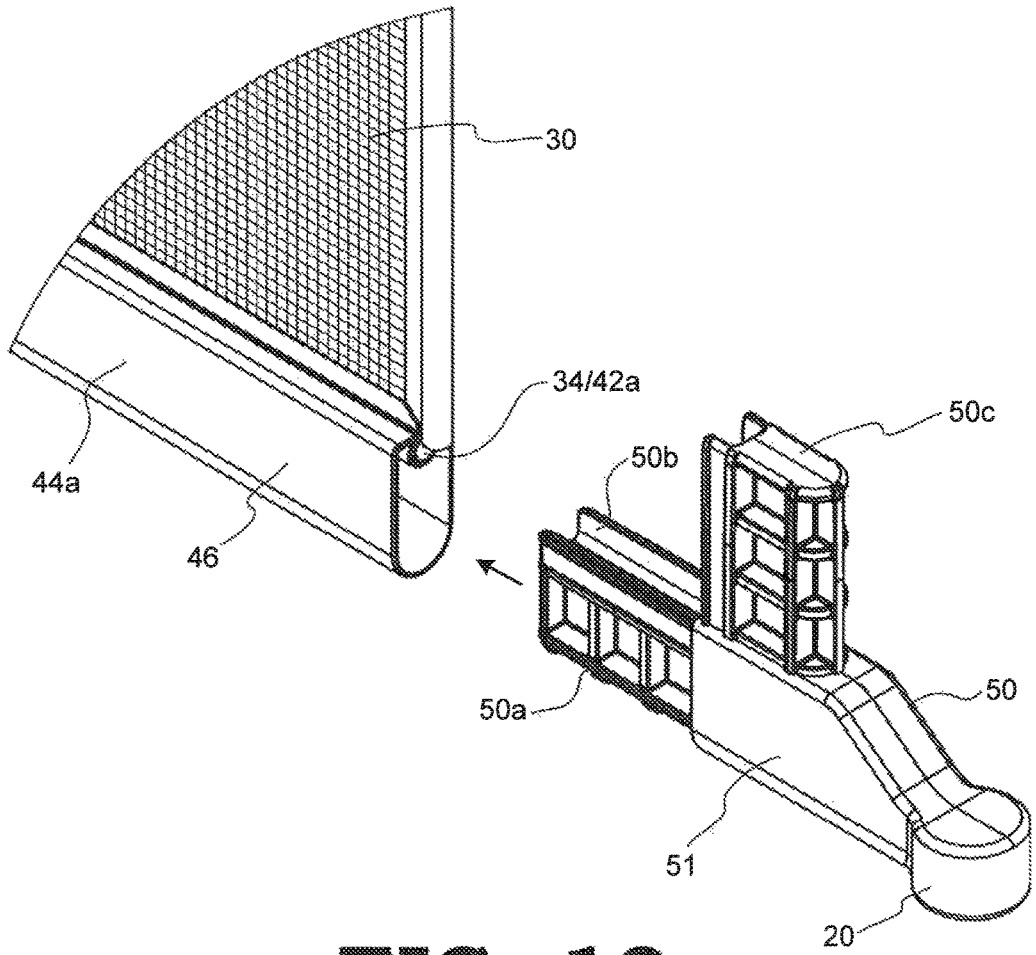
FIG. 10 illustrates a detailed view of the third step from FIG. 9.

FIGS. 9-10 show a third step of assembling the barrier 10 by inserting a first corner joint or member 50 into the lower frame member 44*a*. The first corner member 50 includes a first friction fit stopper, an arm, or an extension 50*a*, a second friction fit stopper 50*c* and the lower hinge 20. As the first corner member 50 is being installed, the first friction fit stopper 50*a* is secured and received by the frame member body 46 of the lower frame member 44*a*.

As shown in greater detail in FIG. 10, an outer surface 50*b* of the first friction fit stopper 50*a* has a substantially similar shape to the inner surface of the lower frame member 44*a*. When the first corner member 50 is completely installed, the first friction fit stopper 50*a* may be completely held by a friction fit with the lower frame member 44*a*. The frame member body 46 may also be flush with an exposed portion 51 of the first corner member 50.

Figure 11:
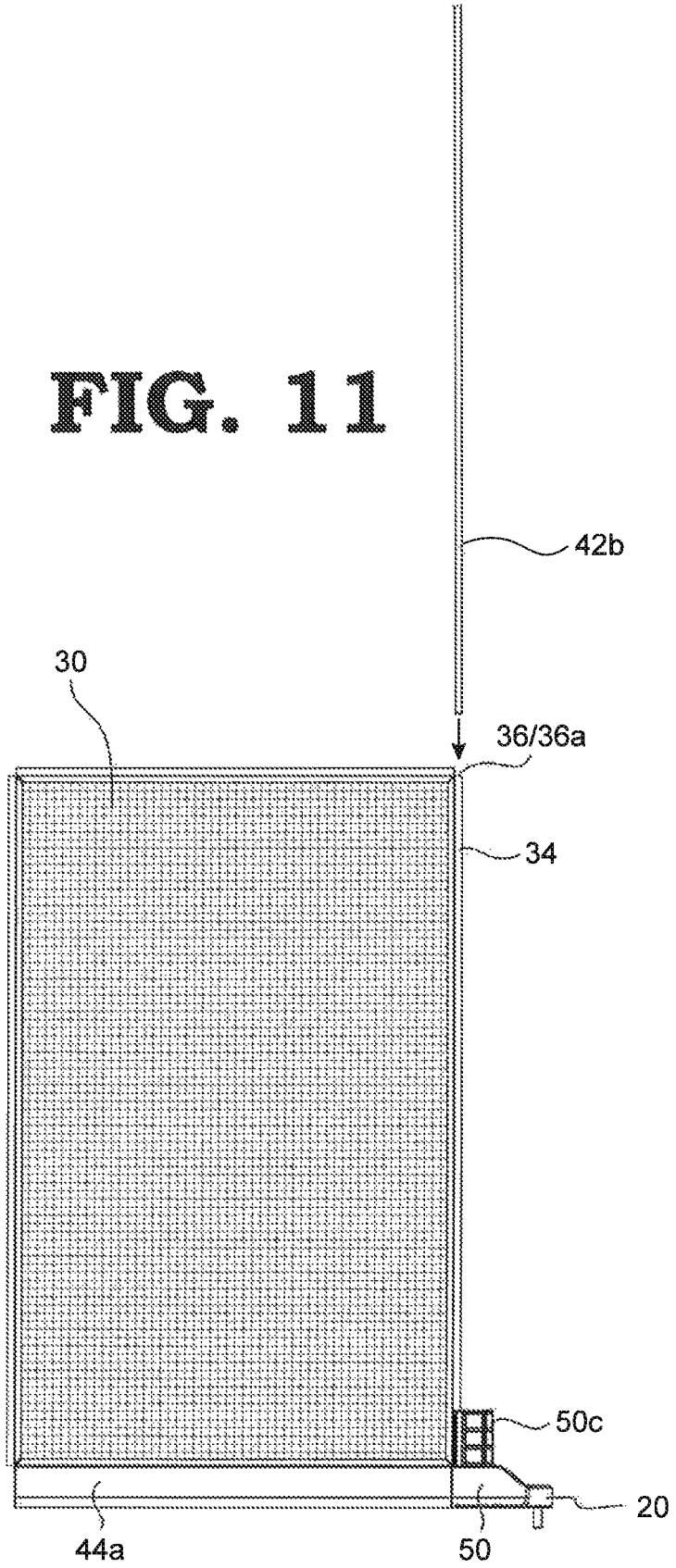
FIG. 11 depicts a fourth step of assembling the barrier by inserting a second rod into a second fold of the mesh panel.

FIG. 11 depicts a fourth step of assembling the barrier 10 by inserting a second rod 42*b* into a second fold 36 of the mesh panel 30. Similar to the first step as shown and described in FIGS. 4-5, the second rod 42*b* slides into the pocket 36 formed by the fold 34 until a length of the second rod 42*b* is substantially congruent to a length of the pocket 36.

Figure 12:
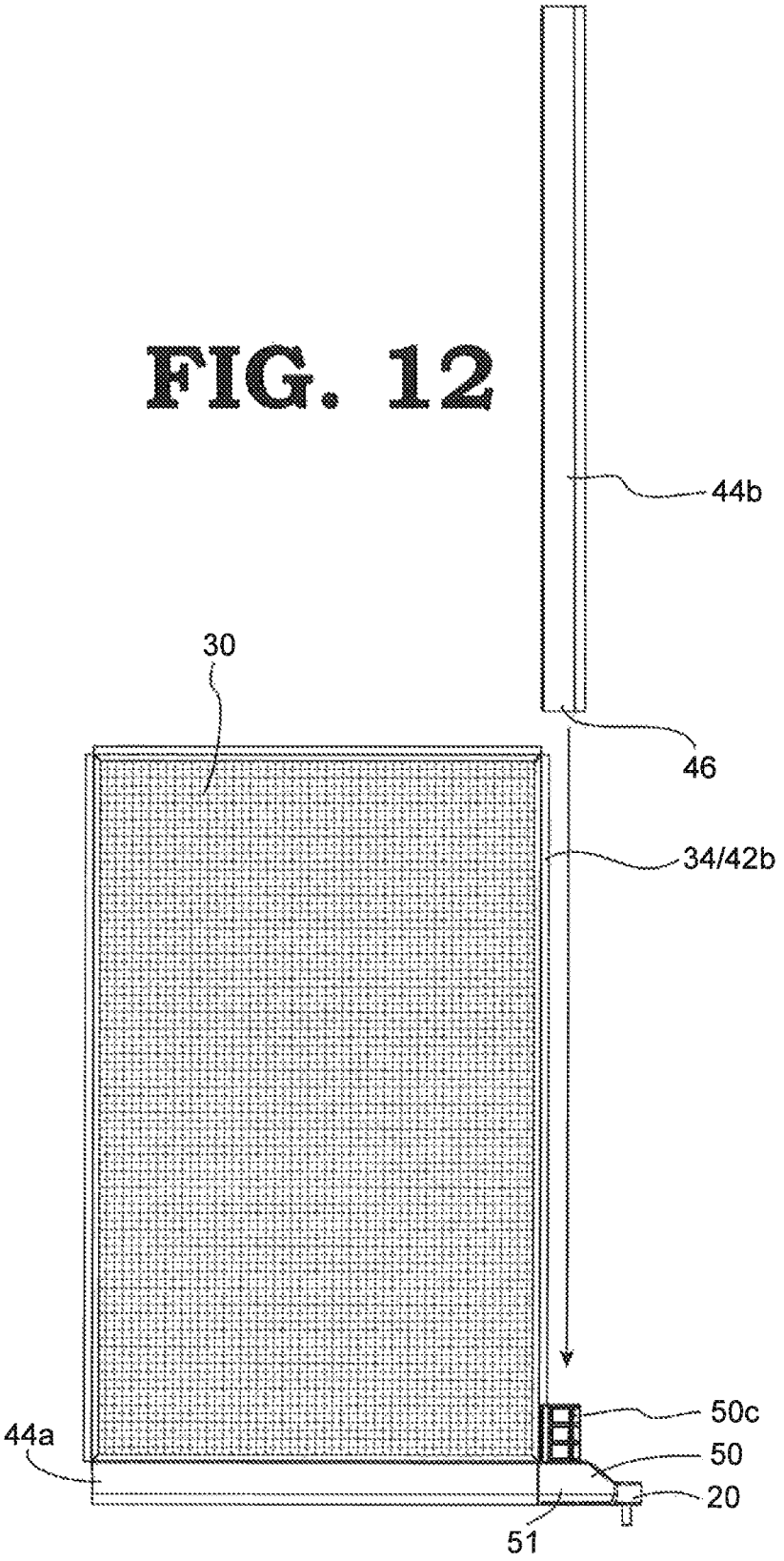
FIG. 12 shows a fifth step of assembling the barrier by attaching a first side frame member to the mesh panel and rod combination.

FIG. 12 shows a fifth step of assembling the barrier 10 by attaching a first side frame member 44*b* to the mesh panel 30 and second rod 42*b* combination. Similar to the second step as shown and described in FIGS. 6-8, the first side frame member 44*b* slidingly receives and secures the fold 34 and second rod 42*b*. Then, the first side frame member 44*b* receives and secures the second friction fit stopper 50*c* of the first corner member 50. Similarly, the first side frame member 44*b* may be substantially flush with the exposed portion 51 of the first corner member 50.

Figure 13:
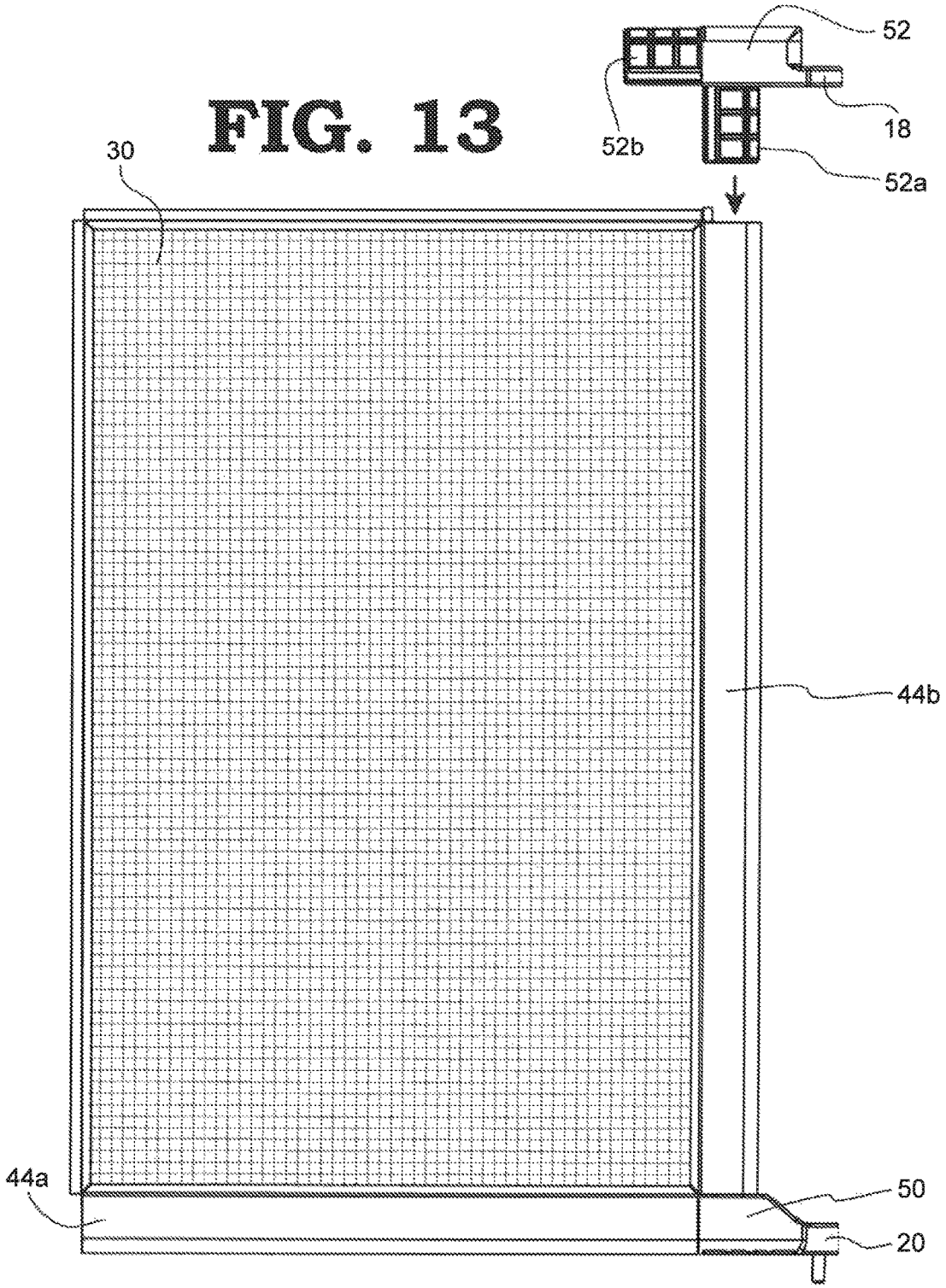
FIG. 13 illustrates a sixth step of assembling the barrier by inserting a second corner member into the first side frame member.

FIG. 13 illustrates a sixth step of assembling the barrier 10 by inserting a second corner member 52 into the first side frame member 44*b*. The second corner member 52 includes a first friction fit stopper 52*a*, a second friction fit stopper 52*b* and the upper hinge 18. The first friction fit stopper 52*a* is secured and received by the first side frame member 44*b*, as similarly shown and described in the third step in FIGS. 9-10.

Figure 14:
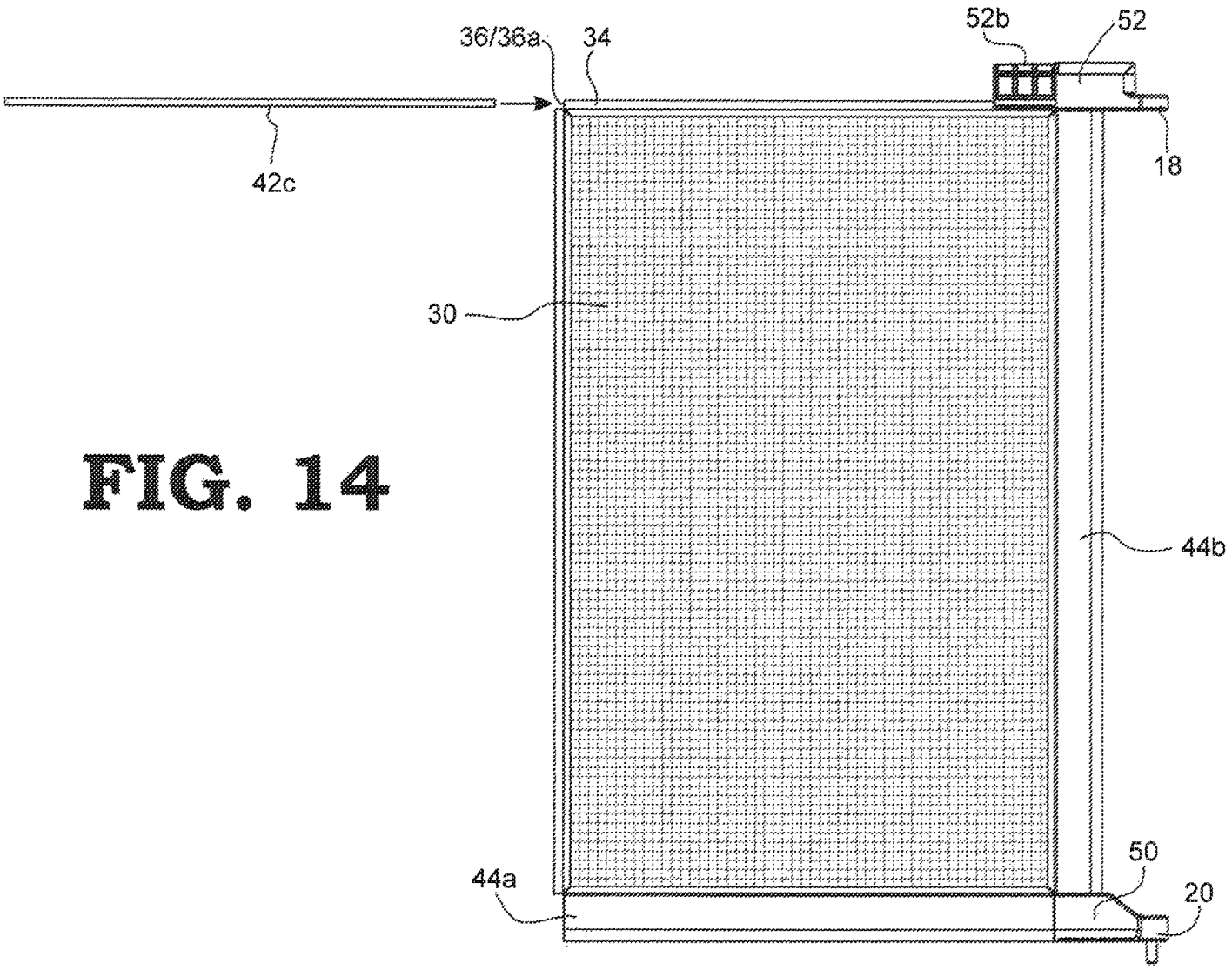
FIG. 14 depicts a seventh step of assembling the barrier by inserting a third rod into a third fold of the mesh panel.

FIG. 14 depicts a seventh step of assembling the barrier 10 by inserting a third rod 42*c* into a third fold 34 of the mesh panel 30. Similar to the first step as shown and described in FIGS. 4-5, the third rod 42*c* slides into the pocket 36 formed by the fold 34 until a length of the third rod 42*c* is substantially congruent to a length of the pocket 36.

Figure 15:
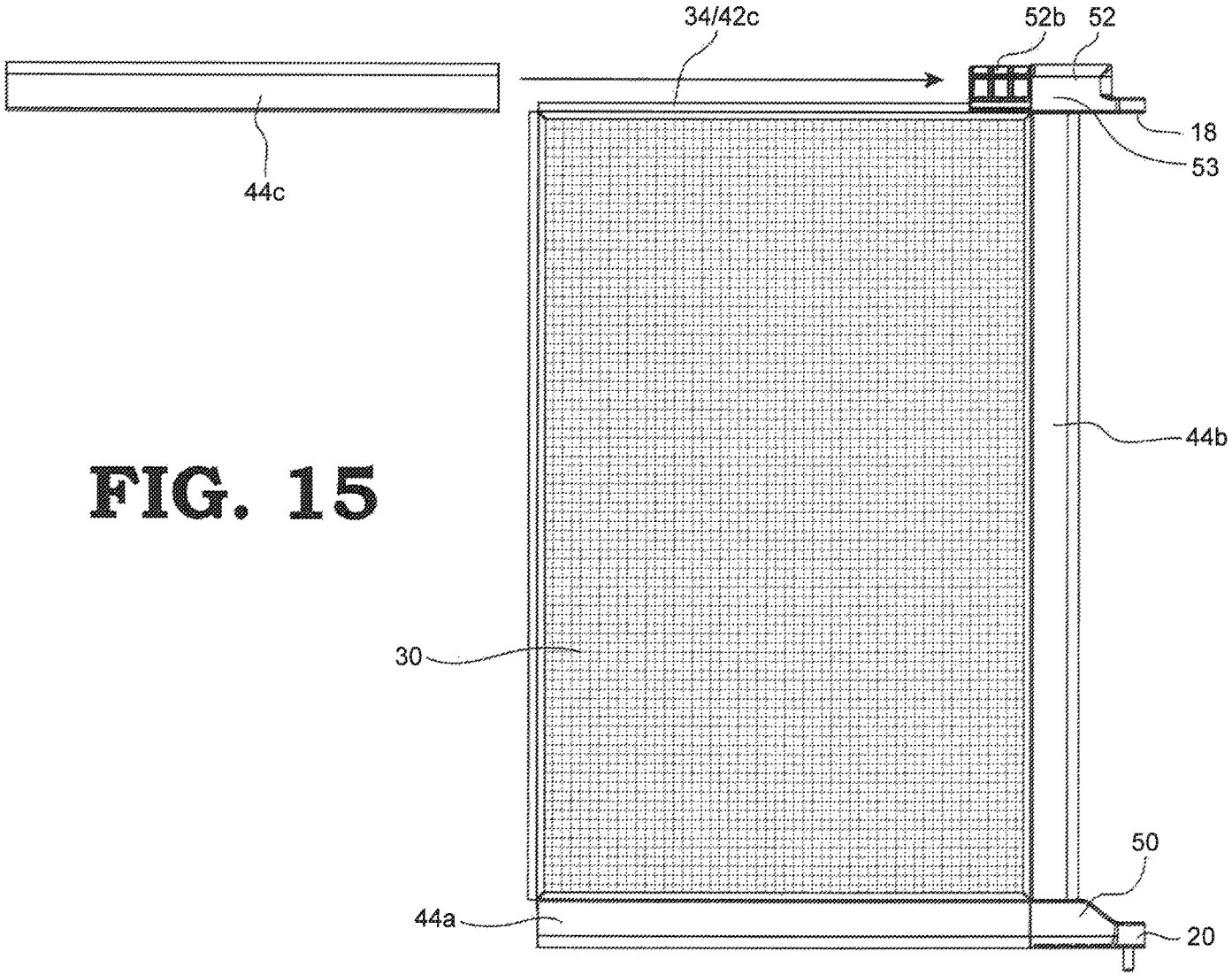
FIG. 15 shows an eighth step of assembling the barrier by attaching an upper frame member to the mesh panel and rod combination.

FIG. 15 shows an eighth step of assembling the barrier 10 by attaching an upper frame member 44*c* to the mesh panel 30 and rod 42*c* combination. Similar to the second step as shown and described in FIGS. 6-8, the upper frame member 44*c* slidingly receives and secures the fold 34 and third rod 42*c*. Then, the upper frame member 44*c* receives and secures the second friction fit stopper 52*b* of the second corner member 52. Similarly, the upper frame member 44*c* may be substantially flush with the exposed portion 53 of the second corner member 52.

Figure 16:
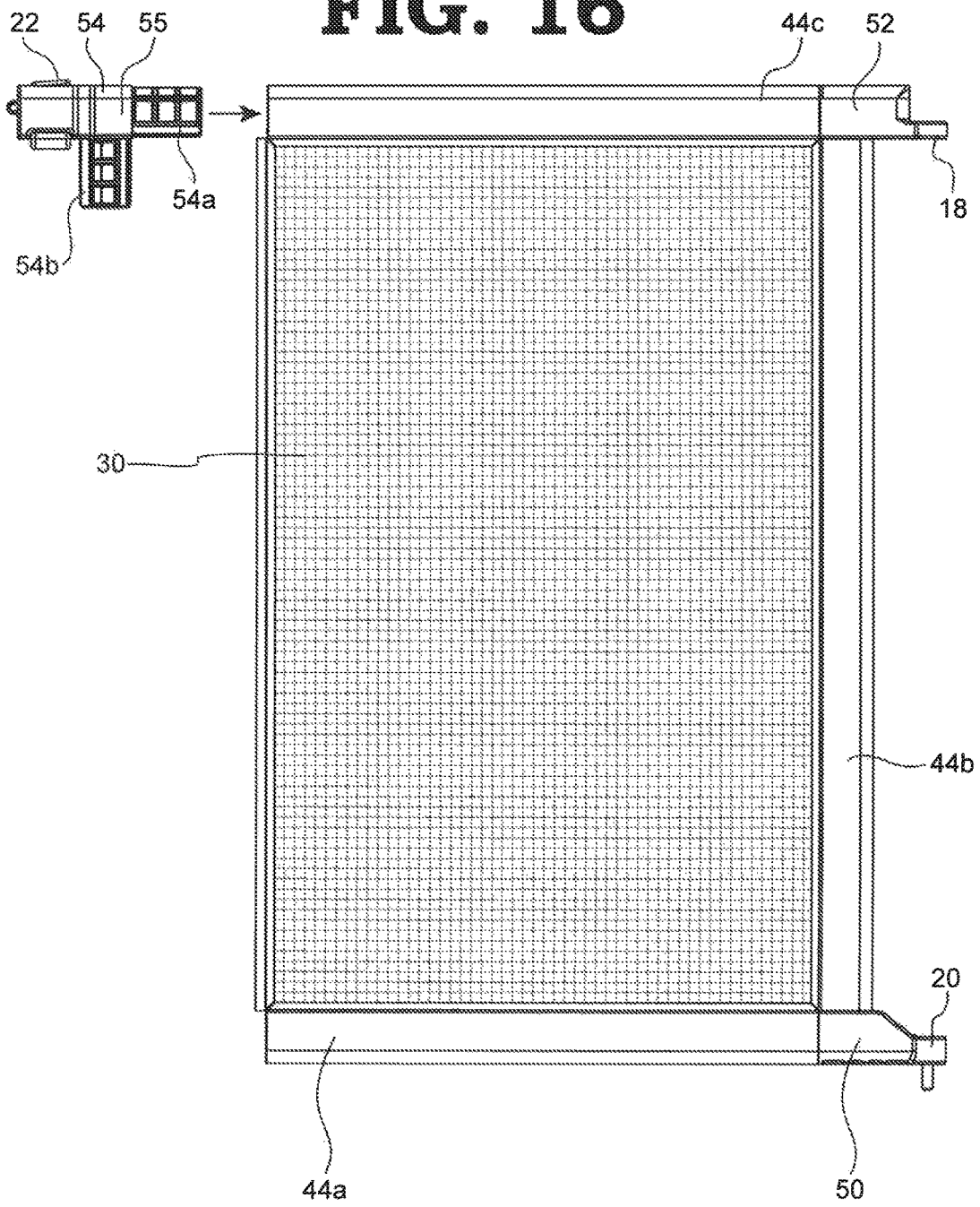
FIG. 16 illustrates a ninth step of assembling the barrier by inserting a third corner member into the upper frame member.

FIG. 16 illustrates a ninth step of assembling the barrier 10 by inserting a third corner member 54 into the upper frame member 44*c*. The third corner member 54 includes a first friction fit stopper 54*a*, a second friction fit stopper 54*b* and the latch 22. The first friction fit stopper 54*a* is secured and received by the upper frame member 44*c*, as similarly shown and described in the third step in FIGS. 9-10.

Figure 17:
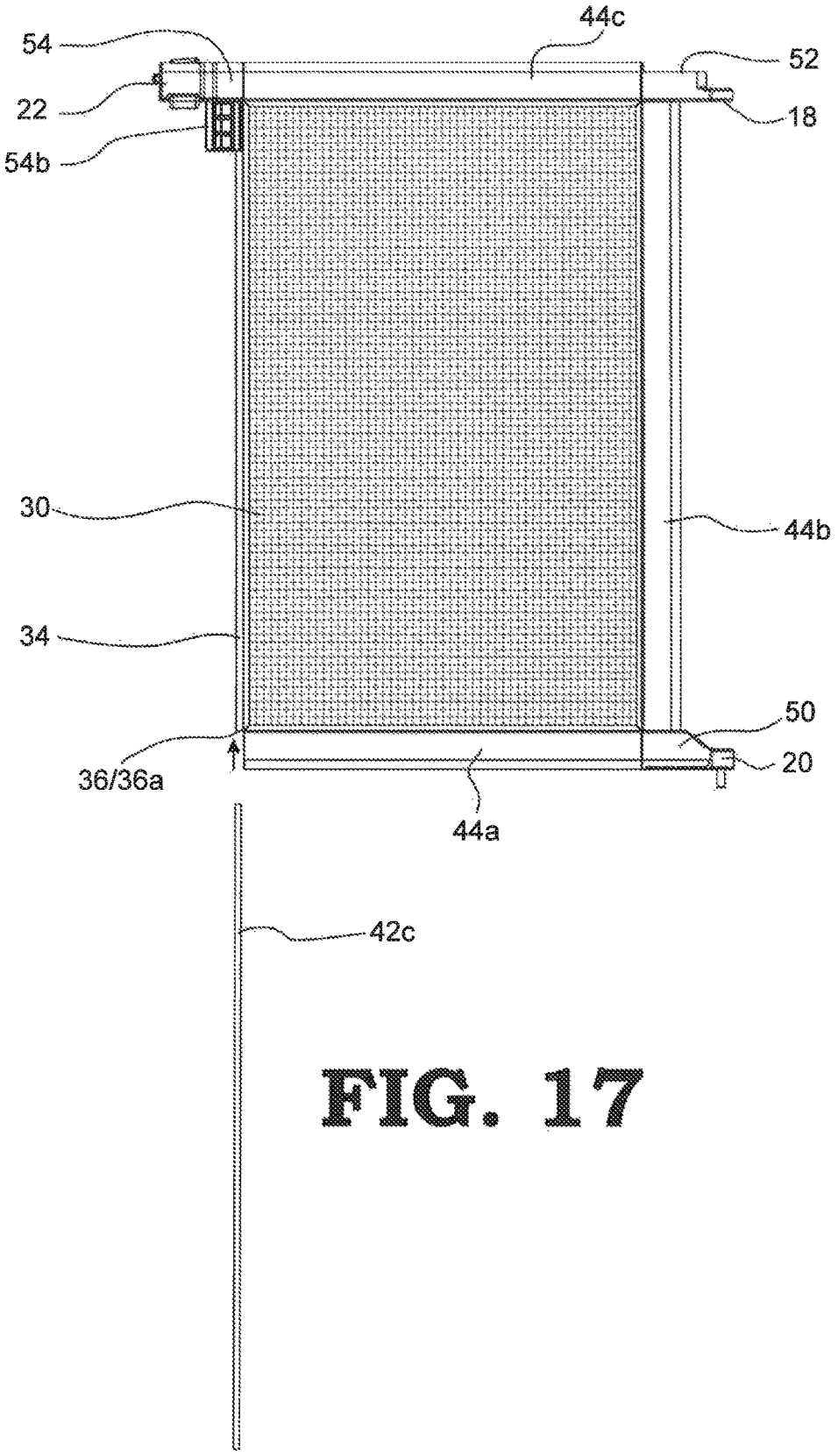
FIG. 17 depicts a tenth step of assembling the barrier by inserting a fourth rod into a fourth fold of the mesh panel.

FIG. 17 depicts a tenth step of assembling the barrier 10 by inserting a fourth rod 44*d* into a fourth fold 34 of the mesh panel 30. Similar to the first step as shown and described in FIGS. 4-5, the fourth rod 42*d* slides into the pocket 36 formed by the fold 34 until a length of the third rod 42*d* is substantially congruent to a length of the pocket 36.

Figure 18:
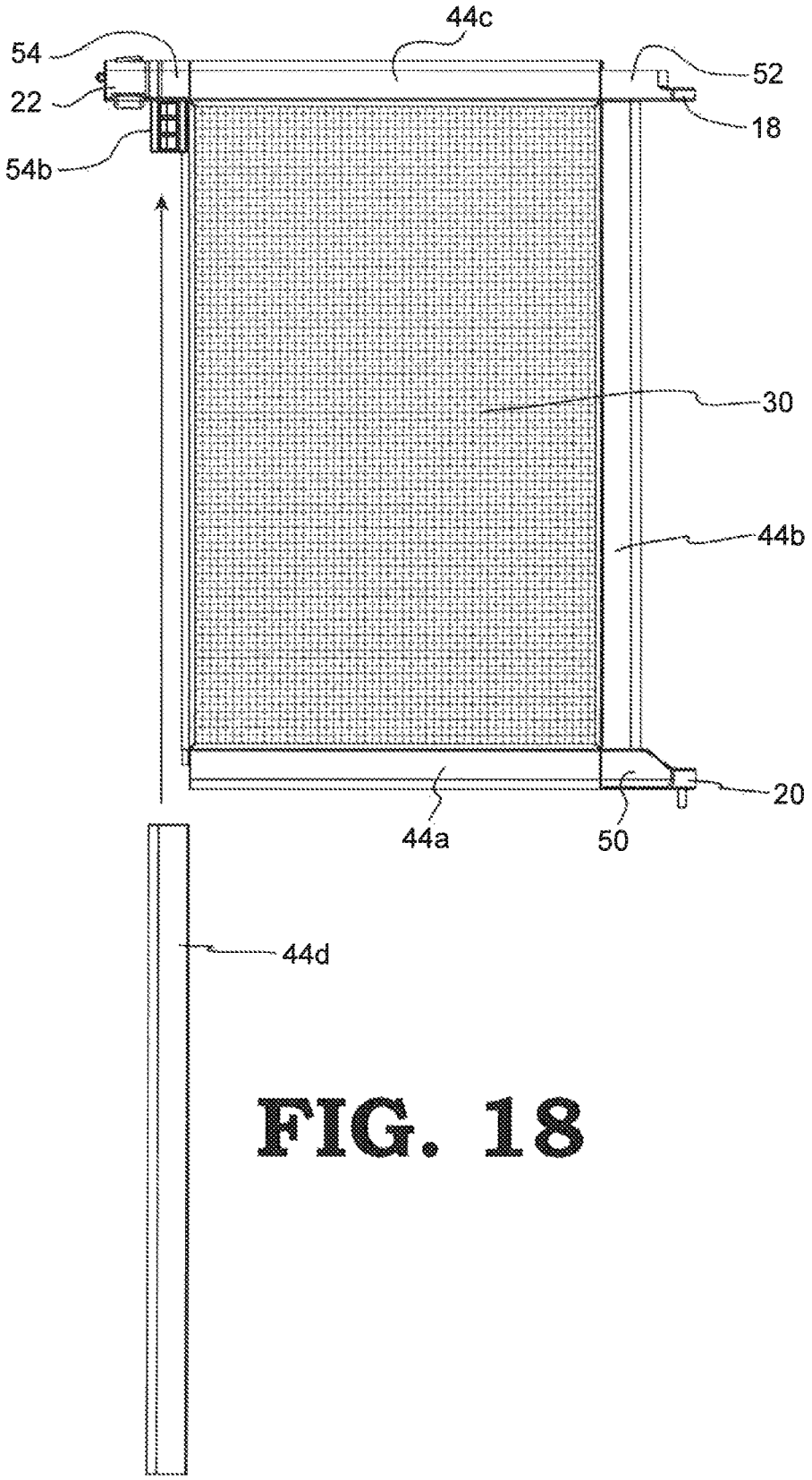
FIG. 18 shows an eleventh step of assembling the barrier by attaching a second side frame member to the mesh panel and rod combination.

FIG. 18 shows an eleventh step of assembling the barrier 10 by attaching a second side frame member 44*d* to the mesh panel 30 and rod 42*d* combination. Similar to the second step as shown and described in FIGS. 6-8, the second side frame member 44*d* slidingly receives and secures the fold 34 and fourth rod 42*d*. Then, the second side frame member 44*d* receives and secures the second friction fit stopper 54*b* of the third corner member 54. Similarly, the second side frame member 44*d* may be substantially flush with the exposed portion 55 of the third corner member 54.

Figure 19:
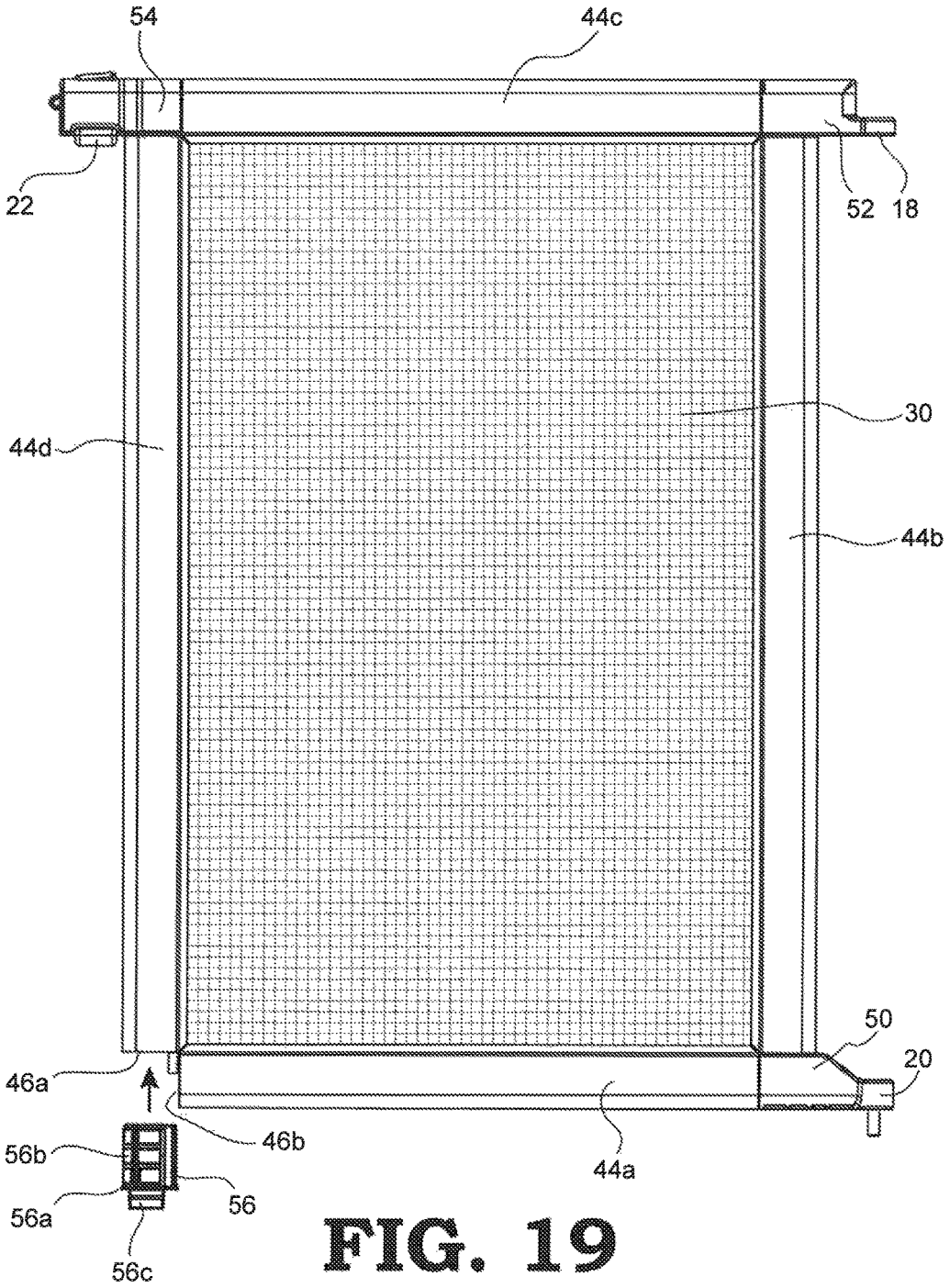
FIG. 19 illustrates a first exemplary embodiment of a twelfth step of assembling the barrier by inserting a corner track into the second side frame member.
Figure 20:
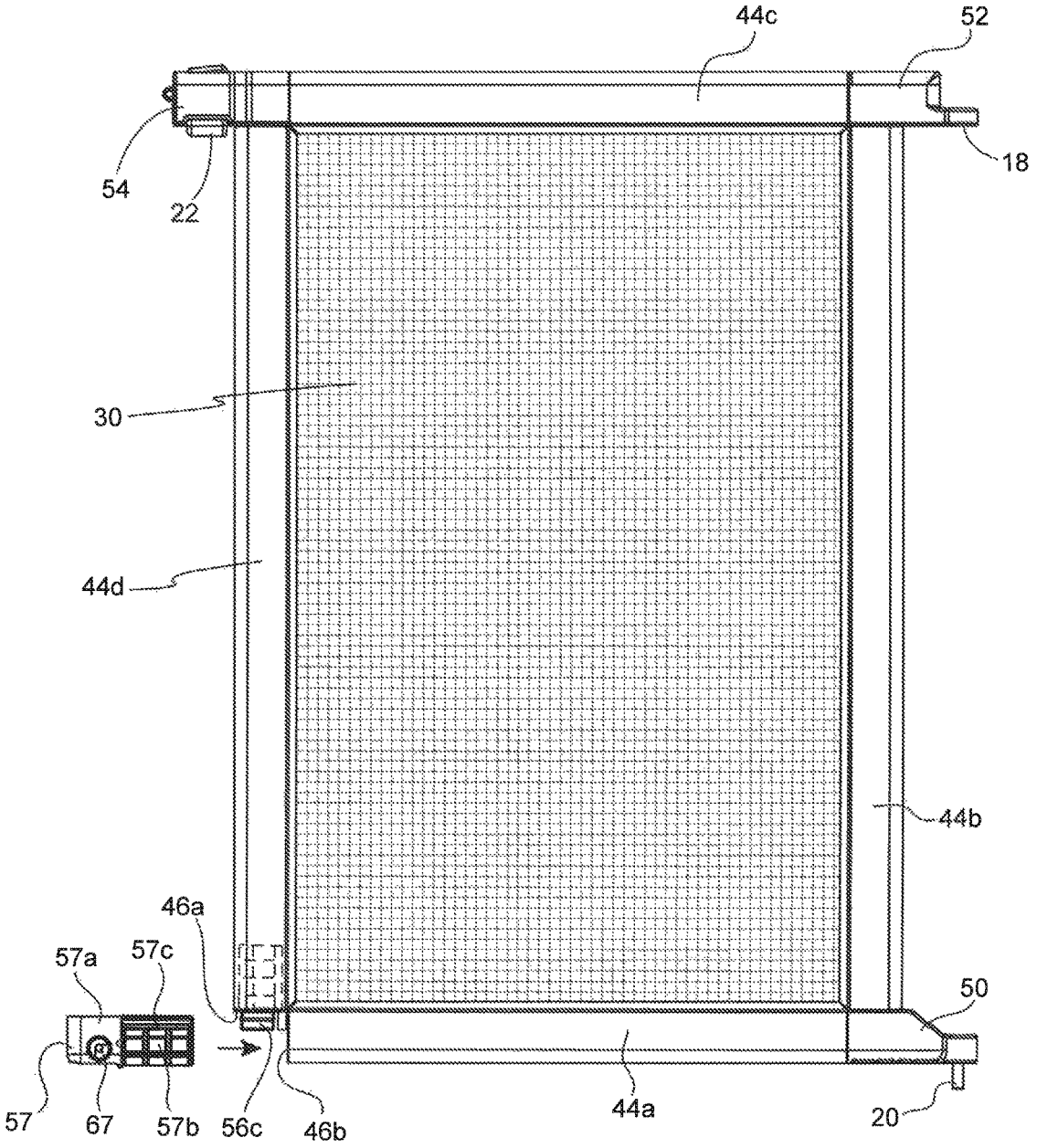
FIG. 20 depicts a first exemplary embodiment of a thirteenth step of assembling the barrier by inserting a fourth corner member into the lower frame member along the corner track.
Figure 21:
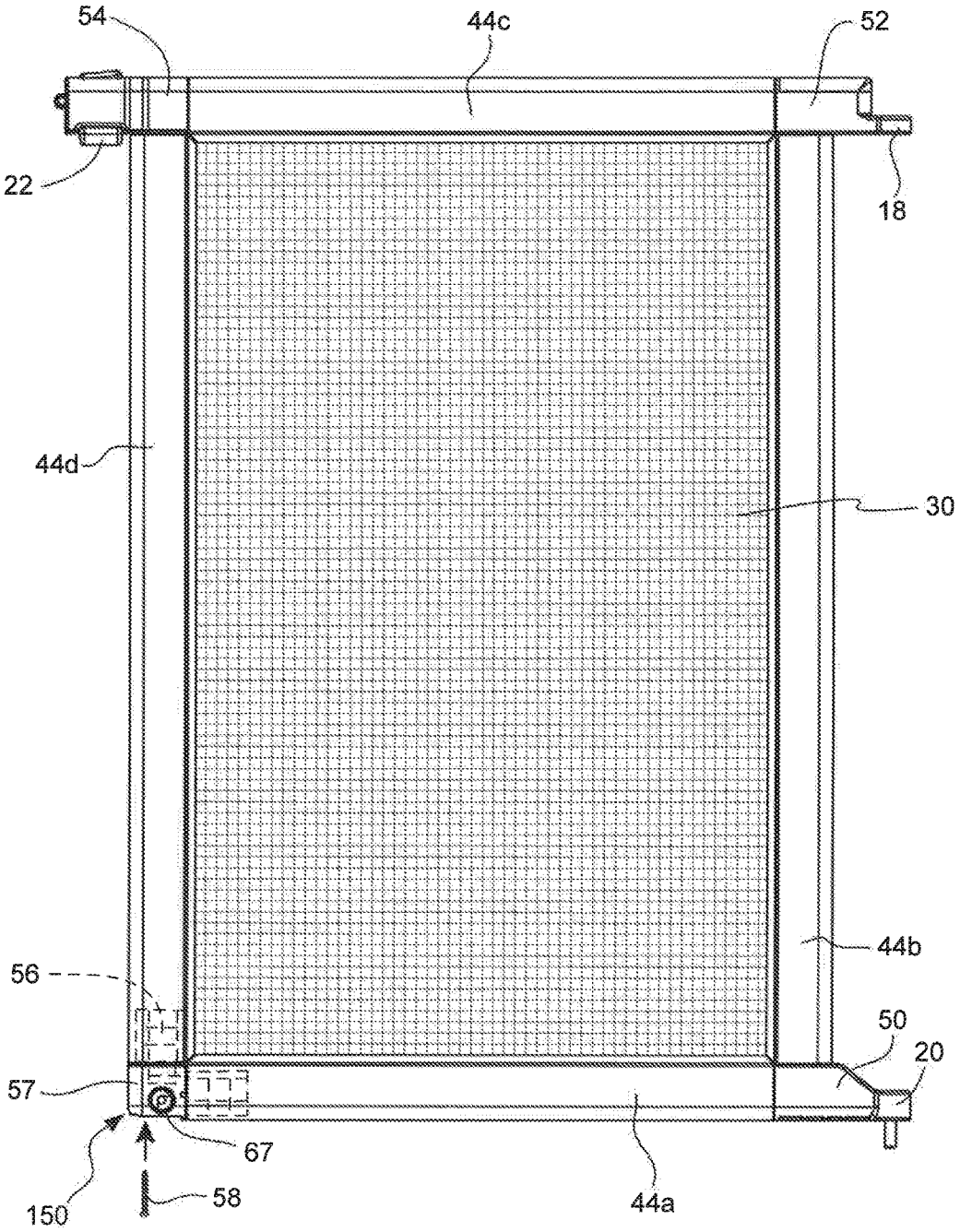
FIG. 21 shows a first exemplary embodiment of a fourteenth and final step of assembling the barrier by inserting a fastener through the fourth corner member and corner track.

FIGS. 19-21 illustrate a first exemplary embodiment of installing a fourth and final two-piece corner joint 150 (as illustrated in FIG. 21). The corner joint 150 is embodied as a two-part assembly having a first part 56 having a first base 56*a* and a first arm or extension 56*b*, and a second part 57 having a second base 57*a* and a second arm or extension 57*b*. The first part 56 being connected to the second part 57 during assembly.

FIG. 19 illustrates a first exemplary embodiment of a twelfth step of assembling the barrier 10 by inserting a first arm 56*b* contoured to fit into a first end 46*a* of frame member body of the second side frame member 44*d* much like in the prior examples discussed above. The first part 56 of the two-piece corner joint 150 includes an elongated projection or fitting 56*c* extending opposite of the first arm 56*b*. The first arm or extension 56*b* is secured and received within an end 46*a* in the frame member body of the second side frame member 44*d* by a friction fit. As shown in position in FIG. 20, the elongated projection or fitting 56*c* extends transverse or substantially perpendicular to an axial length of the second side frame member 44*d*. The elongated projection or fitting 56*c* extends out from the end 46*a* of the frame member body a predetermined distance and is adapted to receive a mating portion constructed on the second part 57 of the two-piece corner joint 150.

Figure 25:
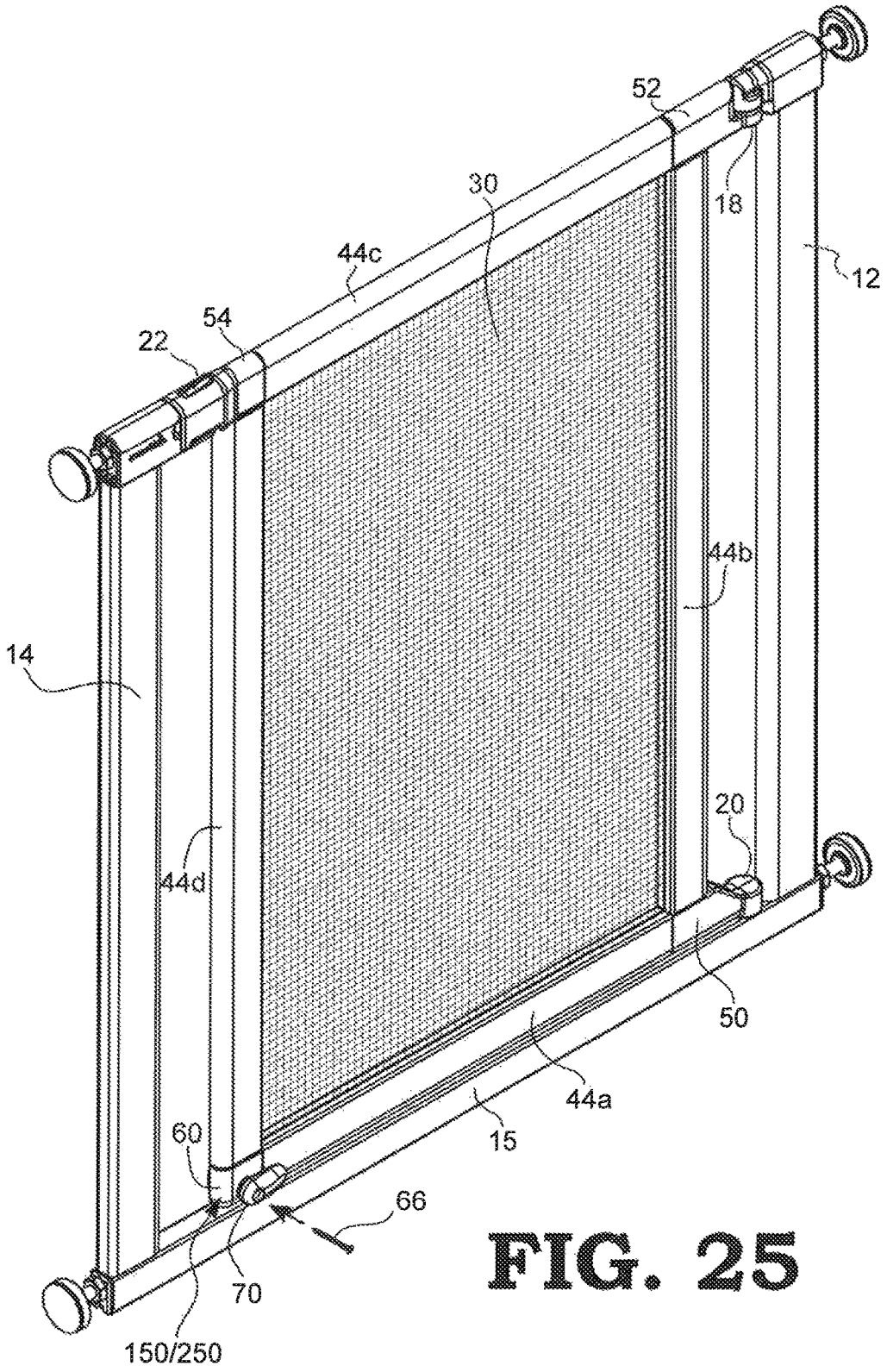
FIG. 25 illustrates a perspective view of a second exemplary embodiment of the fourteenth step of assembling the barrier by inserting a fastener into the fourth corner member and the corner stopper.

FIG. 20 depicts a thirteenth step of assembling the barrier 10 by inserting the second part 57 of the two-piece fourth corner joint 150 or member into an adjacent end 46*b* of the lower frame member 44*a*. The arm or extension 57*b* of the second part 57 of the corner joint 150 or member is secured and received within an adjacent end 46*b* disposed in the lower frame member 44*a* by a friction fit as discussed above in the prior examples. The second part 57 includes an elongated track 57*c* which includes overhang portions (similar to overhang portions 47) which secure and simultaneously receive the elongated projection or fitting 56*c* of the first part 56 as the elongated track 57*c* on the second part 57 is inserted into the adjacent end 46*b* of the lower frame member 44*a*. The second part 57 also includes an aperture 67 adapted to receive a stopper 70 (as shown in FIG. 25) to allow or disallow the barrier door 30 to open and close in a predetermined direction. It is to be understood that the mating connection securing the two-piece corner joint 150 together composed of the first part 56 and the second part 57 may be made in a variety of different ways, such as with a projection and channel combination, a tongue and groove connection, a fastener and/or any other suitable friction fit and/or mating connection between the first part 56 and the second part 57 of the two-piece corner 150 or joint member.

FIG. 21 shows a fourteenth and final step of assembling the barrier 10 by inserting a fastener 58 into and through the second part 57 and into the first part 56 of the fourth corner joint member 150 in order to secure the two parts 56, 57 together. The fastener 58 may be a screw, bolt and nut, magnet, clamp, rivet, or any other suitable fastener to secure the first part 56 to the second part 57 of the fourth corner joint member 150.

Figure 22:
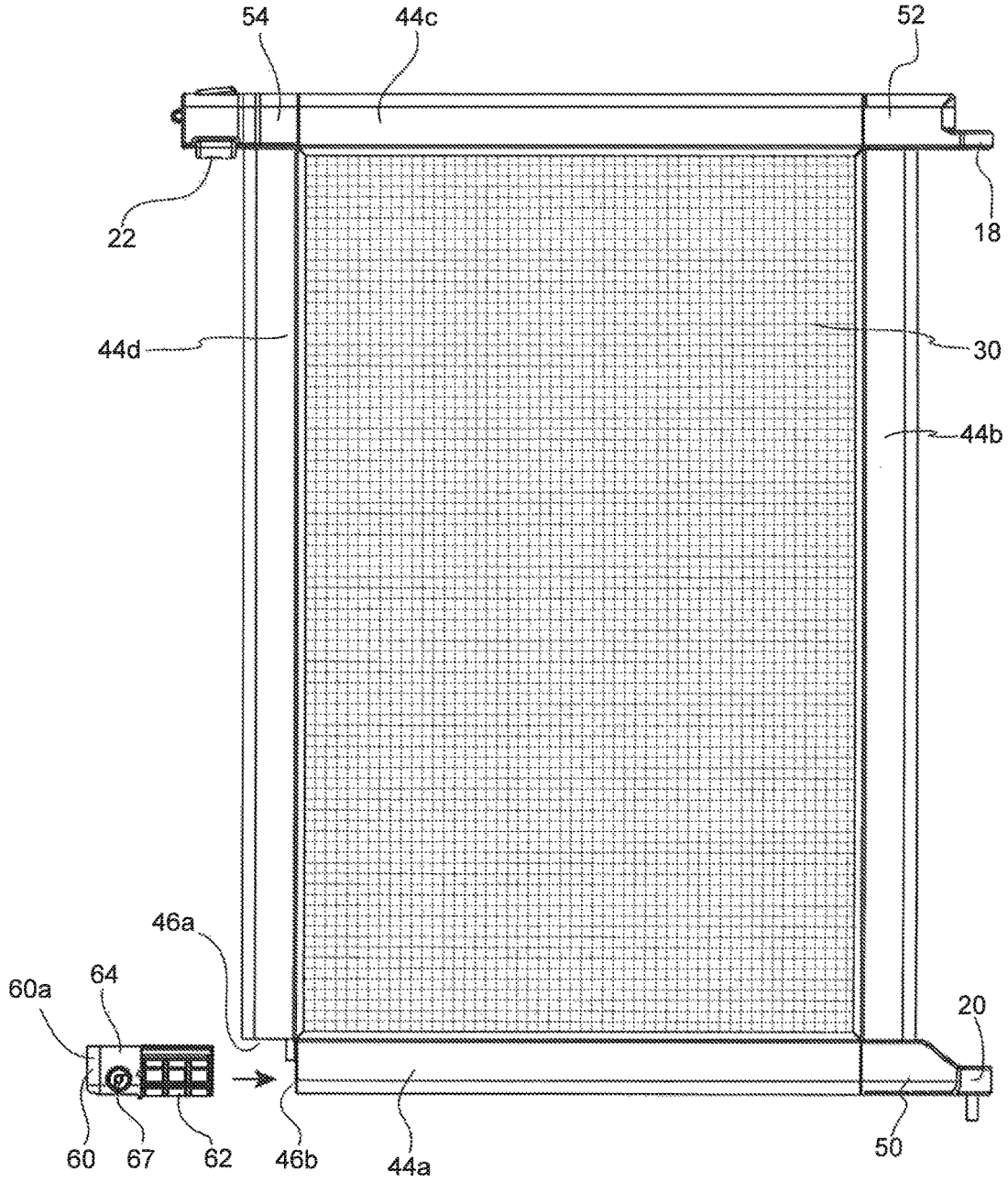
FIG. 22 illustrates a second exemplary embodiment of the twelfth step of assembling the barrier by inserting a fourth corner member into the lower frame member.
Figure 23:
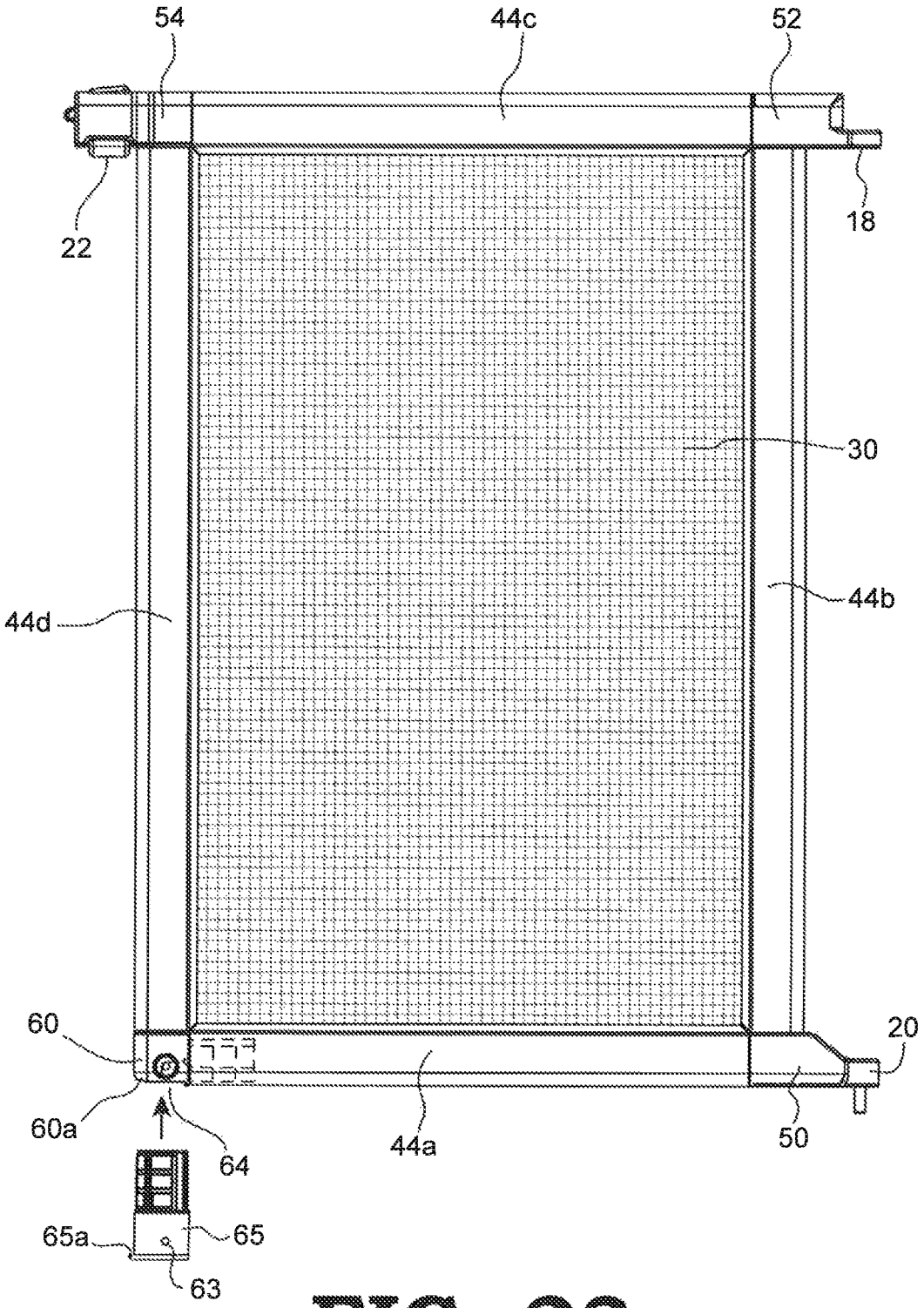
FIG. 23 depicts a second exemplary embodiment of the thirteenth step of assembling the barrier by inserting a corner stopper through a shaft in the fourth corner member and into the second side frame member.
Figure 24:
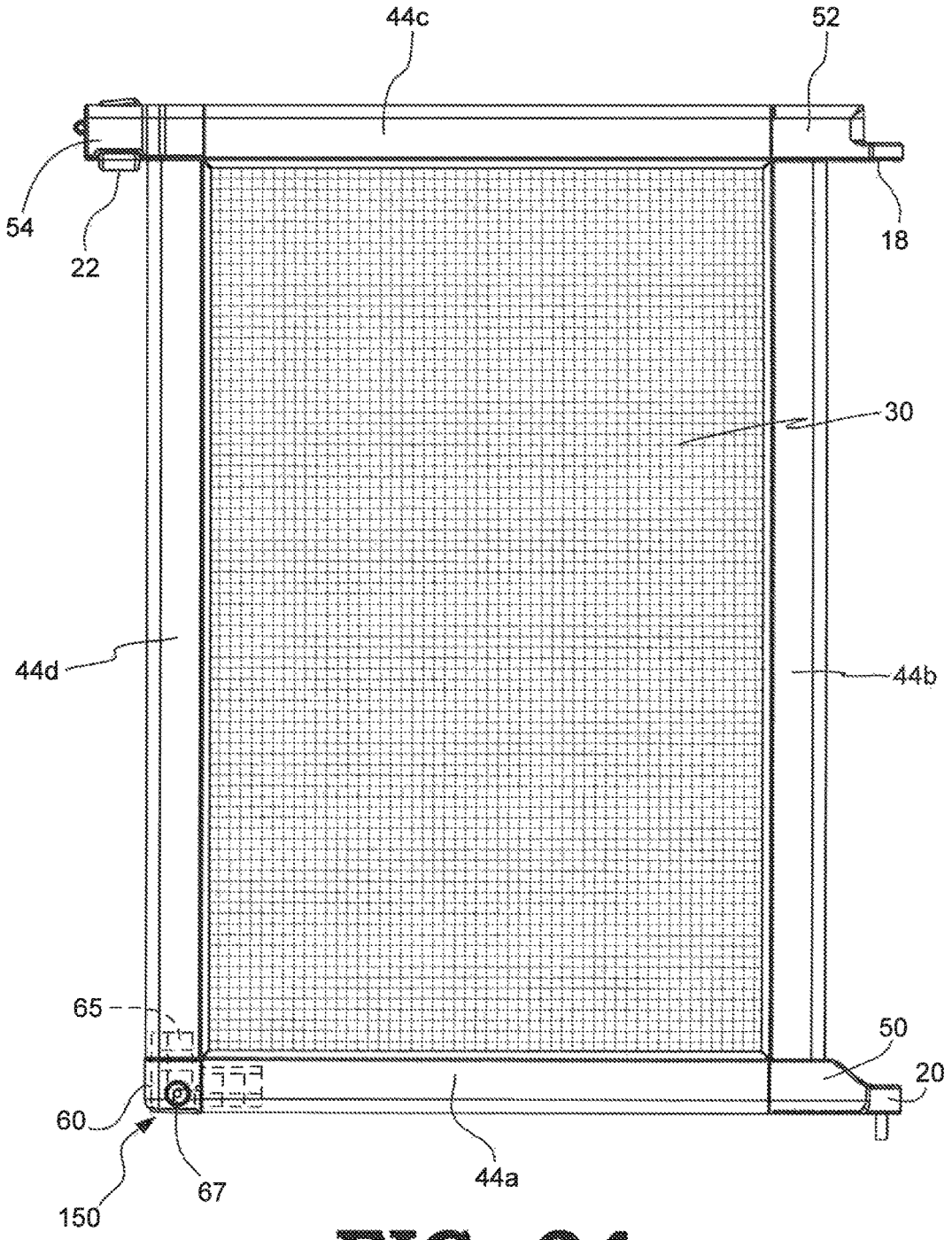
FIG. 24 shows a front view of the assembled barrier as constructed after the thirteenth step of FIG. 23.

FIGS. 22-25 illustrate a second exemplary embodiment of installing a fourth and final corner 150 member 250 (as shown and assembled in FIG. 24).

FIG. 22 illustrates a second exemplary embodiment of the twelfth step of assembling the barrier 10 by inserting a two-piece fourth corner joint 250. The two-piece fourth corner joint 250 includes a first member 60 and a second member 65. The first member 60 is pressed into the adjacent end 46*b* of the lower frame member 44*a*. The first member 60 is secured and received by the lower frame member 44*a* by a friction fit. The first member 60 also includes a base 60*a* having an arm or extension 62 extending from the base 60*a*. An aperture or encircled channel 64 is disposed substantially perpendicular to an axial length of the first member 60 adjacent to the base 60*a* that the encircled channel 64 is aligned with an opening end 46*a* of the frame member body 44*d*. An aperture 66 is provided in the first member 60 to receive a fastener 66. The aperture 66 may also be used to fasten a stopper 70 to the corner joint 250 in assembly such that the fastener 66 is adapted to secure the stopper 70 and the first 60 and second 65 members together by the single fastener 66.

FIG. 23 depicts a thirteenth step of assembling the barrier 10 by inserting the second member 65 through the channel 64 in the first member 60 and into the end 46*a* of the second side frame member 44*d*. A lower edge 65*a* of the second member 65 abuts against a base 60*a* end of the first member 60 when the second member 65 is fully secured and received by the second side frame member 44*d* (as shown in FIG. 24). Furthermore, the second member 65 has an aperture 667 which is substantially aligned with the aperture 66 when installed.

FIG. 24 shows a front view of the assembled barrier 10 as constructed after the thirteenth step of FIG. 23. As shown, the second member 65 is shown disposed in the channel 64 substantially in hidden line. The axial length of the extending second member 65 is shown substantially perpendicular to the axial length of the extending first member 60.

FIG. 25 illustrates a perspective view of a second exemplary embodiment of the fourteenth step of assembling the barrier 10 by inserting a fastener 66 into the aperture 67 in the corner stopper 65 and the first members 56/60 and the second members 57/65 of the corner joints 150/250. As shown the fastener 66 may also pass through a rotating stopper 70. The fastener 66 may be a screw, bolt and nut, magnet, clamp, rivet, or any other suitable fastener to secure the first members 56/60 of the two-piece fourth corner joint member to the second members 57/65.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. A gate, comprising:

an outer casing having a pair of upright frame elements connected to a lower cross element; and a barrier door positioned within the outer casing and hingedly connected to one of the upright frame elements, wherein, the barrier door comprises:

a frame including a first side member and a second side member connected at ends by corner joints that are friction fit connected to an upper member and a lower member, a mesh panel with a fold along an edge, wherein the fold forms an elongated pocket having openings, wherein a rod is inserted into the pocket through the openings;

wherein the first side member, the second side member, the upper member and the lower member comprise hollow structures with tracks that are adapted to accommodate the rod within the elongated pocket;

wherein a first corner joint has a first pair of separable interacting arms, including a first arm friction fit into a first end of the first side member or the second side member, and a separate second arm friction fit into an adjacent end of the upper member or the lower member, and wherein the first arm has an aperture and is interconnected with the second arm to secure the first arm to the second arm, such that the second arm is friction fit into the aperture of the first arm.

2. The gate recited in claim 1, wherein the barrier door has a second corner joint comprising:

a second pair of interacting arms, including a first arm and a second arm, wherein the second joint first arm is friction fit into another first end of the first side member or the second side member, and the second joint second arm is friction fit into another adjacent end of the upper or the lower member.

3. The gate recited in claim 2, wherein the first joint second arm is simultaneously received and secured via a tongue and groove friction fit mating assembly between the first joint first arm and the first joint second arm.

4. The gate recited in claim 2, wherein the first joint second arm is simultaneously received and secured via a projection and channel mating assembly between the first joint first arm and the first joint second arm.

5. The gate recited in claim 2, wherein the first joint first arm, the first joint second arm and a rotating stopper are fixed to each other by a fastener, wherein the rotating stopper can determine the opening and closing direction of the barrier door.

6. The gate recited in claim 2, wherein second corner joint has a hinge integrated therein.

7. A gate, comprising:

an outer casing having a pair of upright frame elements connected to a lower cross element; and a barrier door having a mesh panel positioned within the outer casing, the barrier door hingedly connected to one of the upright frame elements, wherein, the barrier door comprises:

a frame including a first side member and a second side member connected at ends by corner joints that are friction fit connected to an upper member and a lower member, wherein the mesh panel includes a fold along an edge, wherein the fold forms an elongated pocket having openings, wherein a rod is inserted into the pocket through the openings;

wherein the first side member, the second side member, the upper member and the lower member comprise hollow structures with tracks that are adapted to accommodate the rod within the elongated pocket;

wherein a first corner joint is a two-part corner joint and has a first extension that is friction fit into a first end of one of the members, and a second extension friction fit into an adjacent end of another one of the members, and wherein the first extension has a first friction fit element in a first base defining an elongated protrusion that is friction fit into and secured to a second friction fit element on the second extension in a second base defining an elongated track.

8. The gate recited in claim 7, wherein the barrier door has a second corner joint comprising:

a first arm and a second arm, wherein the first arm is friction fit into another first end of the first side member or the second side member, and the second arm is friction fit into another adjacent end of the upper or the lower member.

9. The gate recited in claim 7, wherein the second extension is simultaneously received and secured via a tongue and groove friction fit mating assembly between the first extension and the second extension.

10. The gate recited in claim 7, wherein the second extension is simultaneously received and secured via a projection and channel mating assembly between the first extension and the second extension.

11. The gate recited in claim 7, wherein the first extension and the second extension are locked to each other by a fastener, wherein the fastener also secures a rotating stopper that can determine the opening and closing direction of the barrier door.

12. A mesh gate, comprising:

an outer casing having a pair of upright frame elements connected to a lower cross element; and a barrier door hingedly connected to one of the upright frame elements of the outer casing, the barrier door comprising:

a frame comprising:

a first side member;

a second side member;

an upper member;

a lower member;

a two-part corner joint; and a mirrored set of corner joints, wherein the first side member is friction fit connected at ends by the mirrored set of corner joints to the upper member and the lower member and the second side member is friction fit connected at an end by the two-part corner joint to the upper member or the lower member; and a mesh panel positioned and secured within the frame, wherein the mesh panel includes a fold along an edge, wherein the fold forms an elongated pocket having openings, wherein a rod is inserted into the pocket through the openings;

wherein the first side member, the second side member, the upper member and the lower member comprise hollow structures with tracks that are adapted to accommodate the rod within the elongated pocket;

wherein the two-part corner joint has a first extension arm that is friction fit into a first end of one of the members, and a second extension arm friction fit into an adjacent end of another one of the members, and wherein the first extension arm has a first friction fit element in a first base that is secured to a second friction fit element disposed in a second base on the second extension arm.

13. The mesh gate recited in claim 12, wherein the barrier door has a second corner joint comprising:

a first extension arm and second extension arm, wherein the second joint first extension arm is friction fit into another first end, and the second joint second extension arm is friction fit into another adjacent end.

14. The mesh gate recited in claim 12, wherein the second extension arm is simultaneously received and secured via a tongue and groove friction fit mating assembly between the first extension arm and the second extension arm.

15. The mesh gate recited in claim 12, wherein the second extension arm is simultaneously received and secured via a projection and channel mating assembly between the first extension arm and the second extension arm.

16. The mesh gate recited in claim 12, wherein the first extension arm and the second extension arm are locked to each other by a fastener, wherein the fastener also secures a rotating stopper that can determine the opening and closing direction of the barrier door.

* * * * *